US011541620B2

(12) United States Patent
Gebbink et al.

(10) Patent No.: US 11,541,620 B2
(45) Date of Patent: Jan. 3, 2023

(54) METHOD AND APPARATUS FOR MANUFACTURING SPOUTED POUCH CONTAINERS

(71) Applicant: Fuji Seal International, Inc., Osaka (JP)

(72) Inventors: Jeroen Gerrit Anton Gebbink, Helmond (NL); Masahiro Kaminaga, Amagasaki (JP)

(73) Assignee: Fuji Seal International, Inc., Osaka (JP)

( * ) Notice: Subject to any disclaimer, the term of this patent is extended or adjusted under 35 U.S.C. 154(b) by 218 days.

(21) Appl. No.: 16/718,774

(22) Filed: Dec. 18, 2019

(65) Prior Publication Data

US 2020/0207049 A1 Jul. 2, 2020

(51) Int. Cl.

| | |
|---|---|
| ***B31B 70/84*** | (2017.01) |
| ***B31B 70/64*** | (2017.01) |
| *B31B 155/00* | (2017.01) |

(52) U.S. Cl.

CPC ..... *B31B 70/844* (2017.08); *B31B 70/64* (2017.08); *B31B 2155/00* (2017.08)

(58) Field of Classification Search

None

See application file for complete search history.

(56) References Cited

U.S. PATENT DOCUMENTS 3,069,303 A * 12/1962 Scholle ..... B29C 65/305 156/253
3,244,576 A * 4/1966 Swartz ..... B29K 2827/18 156/513
3,434,908 A * 3/1969 MacDonald ..... B29C 66/80 156/514
4,055,032 A * 10/1977 Hammond ..... B29C 66/47421 53/410

(Continued)

FOREIGN PATENT DOCUMENTS

EP 2 813 359 A1 12/2014
JP S56-118845 A 9/1981

OTHER PUBLICATIONS

Extended European Search Report and Written Opinion dated Jan. 28, 2020 for application No. 19219869.5, 4 pages.

(Continued)

*Primary Examiner* — Nathaniel C Chukwurah
*Assistant Examiner* — Tanzim Imam
(74) *Attorney, Agent, or Firm* — Frost Brown Todd LLC

(57) ABSTRACT

The present disclosure relates to an apparatus and method for manufacturing spouted pouch containers. The method includes arranging an upper and lower strip with their inner sides on top of each other, folding at least one longitudinal edge of the upper strip away from the lower strip to expose both an inner side portion of the folded longitudinal edge of the upper strip and an inner side portion of the lower strip, arranging a spouted cover strip on top of the exposed inner side portions, sealing pairs of side walls of the upper and (Continued)

lower strip to each other and sealing the spouted cover strip to the exposed inner side portion of the lower and upper strips, and cutting the upper strip and lower strip into individual pouch containers. The apparatus is provided for carrying out the manufacturing method.

12 Claims, 18 Drawing Sheets

(56) References Cited

U.S. PATENT DOCUMENTS

| | | | | |
|---|---|---|---|---|
| 4,341,522 | A * | 7/1982 | Gaubert | B31B 70/00 493/213 |
| 2015/0005148 | A1* | 1/2015 | Ohmae | B65D 75/5877 493/194 |
| 2018/0208337 | A1* | 7/2018 | Watanabe | B65B 3/12 |

OTHER PUBLICATIONS

Netherlands Search Report and Written Opinion dated Jun. 19, 2019 for application No. 2022317, 8 pages.

* cited by examiner

- Prior art -

- Prior art -

METHOD AND APPARATUS FOR MANUFACTURING SPOUTED POUCH CONTAINERS

This application is a National Stage Entry of NL Application Ser. No. 2022317, entitled "Method and Apparatus for Manufacturing Spouted Pouch Containers," filed Dec. 27, 2018, the disclosure of which is incorporated by reference herein.

The present disclosure relates to a method and apparatus for manufacturing a plurality of individual spouted pouch containers. The disclosure also relates to spouted pouch containers manufactured using the method and/or apparatus as described herein.

A spouted pouch may comprise walls made of sheet material and a spout fitment sealed to one of the walls. Furthermore, the walls may be sealed (welded) along at least a part of their peripheral edges to form a spout cavity.

Document EP 2 813 359 A1 discloses an apparatus to make plastic bags, each of which includes an end surface provided with a spout. The apparatus forms a first folded portion in a first web of panel material 1 and an aperture in a second web of panel material 2. Furthermore a spout is inserted into the aperture. The spout is heat sealed to the inside of the second web of panel material (i.e. to the side that is at the inside of a finished plastic bag). The second web of panel material is folded after being heat sealed so that a second folded portion is formed in the second web of panel material. Then the spout is turned over by the second folded portion and the first and second folded portions are heat sealed with each other while the second folded portion and the second web of panel material are heat sealed with each other about the spout.

The heat in the heat sealing operations needs to be applied to an area between the spout and the web material in order to avoid the leakage of content of the plastic bag. Furthermore, the web material needs to be conveyed in a state wherein the spouts hang in the apertures in an up-side down position, otherwise the spout cannot be positioned in the right position at the heat sealing process and/or may fall off the aperture before the heat sealing process. In the known apparatus a relatively large sealing area of heat seals is needed and/or the sealing area leaves a space between the spout and the web material where the content enters and any content accumulated and kept in this space may cause quality problems. In case of sterilization of the plastic bag, this space is left unsterilized.

It is an object of the present disclosure to provide a method and apparatus for manufacturing spouted pouch containers wherein at least one of the above-mentioned issues has been at least partially resolved.

It is also an object of the present disclosure to provide a method and apparatus for manufacturing spouted pouch containers wherein the pouch cavity can be better kept clean before the pouch containers are filled with content.

It is also an object of the present disclosure to provide a method and apparatus that enables the efficient and/or fast manufacturing of spouted pouch containers.

According to a first aspect a method for manufacturing a plurality of individual spouted pouch containers, wherein each spouted pouch comprises walls made of sheet material and a spout fitment sealed to one of the walls, the walls being sealed along their peripheral edges to form a spout cavity, the method comprising the steps of:

arranging an elongated upper strip and an elongated lower strip of wall sheet material with their inner sides on top of each other, the upper and lower strips intended to form side walls of the pouch containers;

folding at least one longitudinal edge of the upper strip away from the lower strip to expose both an inner side portion of the folded longitudinal edge of the upper strip and an inner side portion of the lower strip;

arranging at least one spouted elongated cover strip on top of the exposed inner side portion of the upper strip and the exposed inner side portion of the lower strip, wherein the spout fitments of the at least one spouted elongated cover strip have been sealed to the upper side of the elongated cover strip and extend in upward direction relative to the spouted elongated cover strip, the spouted elongated cover strip intended to form spouted top walls of the plurality of pouch containers;

sealing edges of the side walls of the lower and upper strips to each other and to the at least one spouted elongated cover strip to form the pouch cavity.

By arranging the spout fitments at the upper (and therefore outer) side of the top wall, the risk of contaminating material ending up inside the pouch cavity can be reduced.

The method may further comprise;

providing at least one elongated cover strip;

placing spout fitments on top of the at least one elongated cover strip;

sealing the placed spout fitments on the at least one elongated cover strip to form at least one spouted elongated cover strip.

The spout fitments may be sealed by ultrasonic sealing to the at least one elongated cover strip and/or the spout fitments may be sealed right after placing a spout fitment on the at least one elongated cover strip. Ultrasonic sealing can be applied right after the placement of the spout on the film because ultrasonic sealing can be accomplished in a relatively easy manner and/or in a relatively short time interval (relative to heat sealing), in some embodiments even on the fly, i.e. while being transported by the conveyor. Because of the high speed ultrasonic sealing the transport and positioning method and apparatus of the spouts can be made less complicated.

In embodiments of the present disclosure wherein the at least one elongated cover strip comprises a row of consecutive areas arranged at positions corresponding to the intended positions of holes to be made in the material of the elongated cover strip, the method may comprise placing spout fitments at the intended positions in the row of consecutive areas.

In embodiments wherein the method comprises a hole making step in which a hole opening is formed in the top wall, the hole is preferably arranged at the (intended) position of the spout fitment so as to establish communication between the pouch cavity and outside the pouch container. The hole making step may be performed after sealing the spout fitment to the outer surface of the cover strip (top wall). For instance, the manufacturing may be configured so that the steps of arranging the spout fitment on the cover strip and sealing the spout fitment to the outer surface thereof are performed on a first location, for instance a production site, while the hole in the top wall of a manufactured pouch container is formed on a second location remote from the first location, for instance at a filling station wherein the pouch container is filled with content.

In embodiments of the present disclosure the elongated cover strip may be is hole-free, i.e. without holes. No holes have been made in these embodiments in areas that would connect to the openings in respective spout fitments. This means that even if the spout fitments have been placed on the upper side of the elongated cover strip and even if these spout fitments have been welded (sealed) to the upper side of the elongated cover strip, the openings in the spout fitments are not in fluid communication with the pouch cavity. The pouch cavity in these embodiments remains closed of from the outside world and therefore the spout cavity remains clean. Right before the pouch container should be filled with content in a filling machine, respective holes are made in the spouted elongated cover strip, i.e. holes at positions corresponding to the passage opening in the spout fitments, so as to provide access to the pouch cavity.

Therefore, in accordance with embodiments of the present disclosure, the method comprises making holes at positions corresponding to the intended positions. More specifically, the method may comprise making holes in the spouted elongated cover strip after having sealed the spout fitments to the at least one strip and before filling the pouch cavity. Alternatively or additionally, the method may comprise using an elongated cover strip that comprises pre-made holes arranged at positions corresponding to the intended positions. The pre-made holes may have been made at a different geographical location, i.e. different from the production or manufacturing site or may have been made in a pre-processing step at the manufacturing site.

In embodiments of the present disclosure the placing of spout fitments on top of the at least one elongated cover strip comprises aligning the spout fitments with respective holes made or to be made in the at least one elongated cover strip. In this manner the holes may at least partially coincide with the passage openings in the spout fitments so as to provide respective passages to and from the pouch cavity.

In embodiments of the present disclosure the method comprises sealing the lower side of the spout fitments to the upper side of the elongated cover strip.

The arranging of the upper and lower strip may be performed so that they fully overlap with each other. In examples of the present disclosure the upper and lower strips are parallel strips transported on a conveyor. In embodiments of the present disclosure the width of the upper strip is the same as the width of the lower strip. Furthermore any markings on the outer sides of the upper and inner strip (for instance, logo's, text, positioning markers, etc.) fully coincide when the upper and inner strips are arranged back-to-back on each other.

In embodiments of the present disclosure the sealing of the cover strip to the exposed inner side portion of the lower strip comprises sealing the cover strip only to the exposed inner side portion of the lower strip. Similarly, sealing the cover strip to the exposed inner side portion of the upper strip may comprise sealing the cover strip only to the exposed inner side portion of the upper strip. In this manner the sealing (comprising pressing the cover strip and the lower/upper strip against each other and then inducing heat, preferably using ultrasound) can be facilitated.

The method may comprise after sealing the spouted elongated cover strip to the exposed inner side portion of the lower strip cutting into shape the exposed inner side portion of the lower strip and the spouted elongated cover strip connected thereto. Similarly, the method may comprise after sealing the spouted elongated cover strip to the exposed inner side portion of the upper strip, cutting into shape the exposed inner side portion of the upper strip and the spouted elongated cover strip connected thereto.

In a further embodiment the method comprises arranging an elongated bottom strip between the upper strip and lower strip. The bottom strip is intended to form the bottom walls of the pouch containers, in case pouch containers having a bottom wall are to be manufactured. In other embodiments the pouch container does not have a separate bottom wall and the container bottom is formed by the lower end of the side walls.

In a further operation both the upper strip and lower strip are at least partially connected to the bottom strip by sealing, for instance by heat sealing.

The method may make use of the elongated upper strip and elongated lower strip, possibly also the bottom strip, to originate from a single web that is provided as a roll of web material. In case of the single web material only providing the basis for an elongated upper strip and an elongated lower strip the method may comprise:

- unwinding the single web including the elongated upper strip and the elongated lower strip;
- cutting the single web so as to separate the upper strip and the lower strip from each other;
- arranging the inner sides of the separated upper and lower strips on each other.

In case the single web material also provides basis for an elongated bottom strip, the method may comprises

- unwinding a single web including the elongated upper strip, the elongated lower strip and an elongated bottom strip, the bottom strip intended to form bottom walls of the pouch container.
- cutting the single web so as to separate the upper strip, the lower strip and the bottom strip from each other;
- arranging the inner sides of the separated upper and lower strips on each other;
- arranging the bottom strip between the upper strip and lower strip.

The elongated bottom strip can be formed into a flattened tubular shape in order to form a double bottom (i.e. a bottom for two parallel combinations of upper/lower strips) or into a flattened U-shape in order to form a single bottom for one combination of upper/lower strips.

Ultrasonic sealing or welding has a number of advantages. Ultrasonic sealing can be applied right after the placement of the spout fitment on the cover strip. A further advantage is that there is no complicated conveying process needed for positioning the spout fitment. Preferably, also the connection of the walls to each other is performed by ultrasonic sealing.

The walls of the pouch container may be made of flexible material. Preferably the material is flexible enough to allow the container to collapse so that the content of the container may be dispensed without resulting in a negative pressure inside the pouch which otherwise might cause ambient air to enter the pouch. The walls of the spout container can for instance be made of sheet material comprising three (or more) layers, wherein the outer layer is mainly made of polyolefin, preferably polyethylene (PE). The spout the spout fitment is mainly made of the same material or compatible material as the outer layer of the spouted top wall. This allows ultrasonic welding of the spout fitment to the outer layer (i.e. the upper layer when the spout fitment is placed upon the top wall).

The pouch container may a container wherein the side walls of the pouch container are rectangular sheets connected to form a generally tubular pouch container portion. The method then may comprise connecting a first rectangular sheet of a first side wall to a second rectangular of a second side wall by sealing the longitudinal edge parts of the first and second sheet to each other to form the tubular pouch container portion, and/or may comprise connecting a third sheet of a top wall by sealing associated transversal edge parts of the first and second sheet to the third sheet and/or further comprising connecting a fourth sheet of a bottom wall by sealing associated transversal edge parts of the first and second sheet to the fourth sheet.

The pouch container may have a spout fitment comprising an attachment flange extending in a first direction and a tubular spout part extending in a second direction, the second direction being essentially perpendicular to the first direction. The attachment may be formed by a ring-shaped attachment flange and a cylindrical tubular spout part, although other shapes are also possible. For instance, the tubular spout part could have any shape in cross-section, such as (but not limited to) a circular shape, rectangular shape, etc. or could take a rectangular shape at the bottom end and a circular shape at the top end.

In preferred embodiments the sealing of a spout fitment to the cover strip comprises sealing only the attachment flange to the outer surface of the cover strip.

The tubular spout part may have been provided with a connection member of a cap member for allowing the pouch fitment the closed off. The cap member may be configured to be moved between a closed position for maintaining the content inside the spouted pouch container and an open position to allow the content to be dispensed through the tubular spout part.

If the spout fitment comprises an attachment flange, the attachment flange may comprise a center area and a peripheral area around the center area. In this case the method may comprise sealing the spout fitment in the peripheral area to the cover strip. In a possible embodiment, the central area may be defined as the segment that is arranged around a pouring opening in the attachment flange and the peripheral area is located radially outwardly relative to the central area. For instance, the width ($w_2$) of the peripheral area may be about 20% of the width ($w_1$) of the central area or less.

In embodiments of the present disclosure the spout fitment is only secured to the outer surface of the elongated cover strip to form the top wall (cover). The spout fitment is therefore not secured to the inner surface of the top wall, preferably not even secured to any other inner surface of the pouch container. In a further embodiment there is even no contact between the spout fitment and any of the inner surfaces of the pouch container. This leaves the possibility to arrange the spout fitment on a part of the pouch container wherein no (dispensing) hole has been provided yet. As mentioned before, the spout fitment can be attached to the outer side of a completely closed pouch container. When the pouch container can remain closed, the interior of the pouch container can be maintained clean or even sterile more easily.

In embodiments of the present disclosure the top wall, preferably also the one or more side walls and possibly also the bottom wall comprises three layers, wherein the outermost layer is made of polyolefin, for example polyethylene (PE) or polypropylene (PP). The inner layer can be made of any material used for an ordinal pouch container. The intermediate layer may be formed by any material used for the ordinal pouch container in order to add a liquid barrier property, a gas barrier property or the like depending on the expected content of the pouch container.

More specifically, the outer layer can be formed by a material containing more than 50% polyolefin, preferably PE, and the spout fitment can be formed by the material containing more than 50% of the same polyolefin used for the outer layer. If the main material of the spout fitment and the main material of the outer layer are not the same, it may be difficult to obtain a sufficient sealing strength. Such materials may allow for the use of ultrasonic welding to attach the spout to the outer layer. Furthermore, the use of PE may reduce the cost of the required sheets. Ultrasonic welding can be applied directly to the spout fitment to seal the spout fitment to the outer layer, which means that the spout can be placed on the outer layer and ultrasonic welding is applied right after the placement.

According to another aspect a spouted pouch container manufactured by the method and/or apparatus as defined herein.

According to another aspect an apparatus is provided for manufacturing a plurality of individual spouted pouch containers, wherein each spouted pouch comprises walls made of sheet material and a spout fitment sealed to one of the walls, the walls being sealed along their peripheral edges to form a spout cavity, the apparatus comprising:

- a conveyor for conveying wall sheet material in a transport direction and guiding the wall sheet material along a number of handling stations, the handling stations including:
- a handling unit configured to arrange an elongated upper strip and an elongated lower strip of wall sheet material with their inner sides on top of each other, the upper and lower strips intended to form side walls of the pouch containers;
- a folding unit configured to fold at least one longitudinal edge of the upper strip away from the lower strip to expose both an inner side portion of the folded longitudinal edge of the upper strip and an inner side portion of the lower strip;
- a placement unit configured to arrange at least one spouted elongated cover strip on top of the exposed inner side portion of the upper strip and the exposed inner side portion of the lower strip, wherein the spout fitments of the at least one spouted elongated cover strip have been sealed to the upper side of the elongated cover strip and extend in upward direction relative to the spouted elongated cover strip, the spouted elongated cover strip intended to form spouted top walls of the plurality of pouch containers;
- a seal press unit configured to seal edges of the side walls of the lower and upper strips to each other and to the at least one spouted elongated cover strip to form the pouch cavity.

The conveyor may be configured to transport an at least one elongated cover strip along the placement unit. The placement unit may be configured to place spout fitments on top of the at least one elongated cover strip and seal the placed spout fitments on the at least one elongated cover strip to form at least one spouted elongated cover strip.

The placement unit may be is configured to place the spout fitments at intended positions in a row of consecutive areas arranged at positions corresponding to the intended positions of holes to be made in the material of the elongated cover strip.

In an embodiment the apparatus comprises a perforation unit configured to make holes in the elongated cover, wherein the perforation unit is preferably configured to make holes at positions corresponding to the intended positions.

The placement unit may be further configured to align the spout fitments with respective holes made or to be made in the at least one elongated cover strip transported by the conveyor.

The seal press unit may be configured to seal pairs of side walls of the upper and lower strip to each other and sealing the spouted elongated cover strip to the exposed inner side portion of the lower strip, the apparatus further comprising:

a first turning unit configured to turn the spouted elongated cover strip to orientate the spout fitments in a downward direction;

a second turning unit configured to turn the spouted elongated cover strip back to again orientate the spout fitments in an upward direction.

The seal press unit may be configured to sealing the spouted elongated cover strip to the exposed inner side portion of the upper strip after spouted elongated cover strip has been turned by the first turning unit and before the spouted elongated cover strip has been turned by the second turning unit.

The handling unit may further be configured to arrange an elongated bottom strip between the upper strip and lower strip, the bottom strip intended to form bottom walls of the pouch containers, preferably comprising further a seal press unit configured to seal both the upper strip and lower strip to the bottom strip.

The conveyor may be is configured to unwind a single web including the elongated upper strip and the elongated lower strip and to transport the unwound single web along a separation unit. In an embodiment the separation unit may be configured to cut the single web so as to separate the upper strip and the lower strip from each other, and to arrange the inner sides of the separated upper and lower strips on each other.

The conveyor may be configured to unwind a single web including the elongated upper strip, the elongated lower strip and an elongated bottom strip, the bottom strip intended to form bottom walls of the pouch container, and to transport the unwound single web along a separation unit. The separation unit may be further configured to cut the single web so as to separate the upper strip, the lower strip and the bottom strip from each other and arrange the inner sides of the separated upper and lower strips on each other, and to arrange the bottom strip between the upper strip and lower strip.

Further characteristics of the present disclosure will be elucidated in the accompanying description of various embodiments thereof. In the description reference is made to the annexed figures.

FIG. 1 presents a cross-section of an upper part of an embodiment of a spouted pouch container, produced in a manner that is known from the state of the art.

FIG. 2 presents a detail view of FIG. 1.

FIG. 3 presents a cross-section of an embodiment of a spouted pouch manufactured in accordance with the manufacturing method of the present disclosure.

FIG. 4 presents a detail view of FIG. 3.

FIGS. 5-8 are cross-sections of an upper part of further embodiments of a spouted pouch container, manufactured in accordance with examples of the manufacturing method of the present disclosure.

FIG. 9 presents a detailed cross-section of an embodiment of a multi-layer wall of a pouch container.

FIGS. 10 and 11 present respectively a top view and a bottom view of an embodiment of a spout in accordance with the present disclosure.

Reference will now be made in detail to exemplary embodiments which are illustrated in the accompanying drawings, wherein like reference numerals refer to the like elements throughout. Exemplary embodiments are described below with reference to the figures.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1:
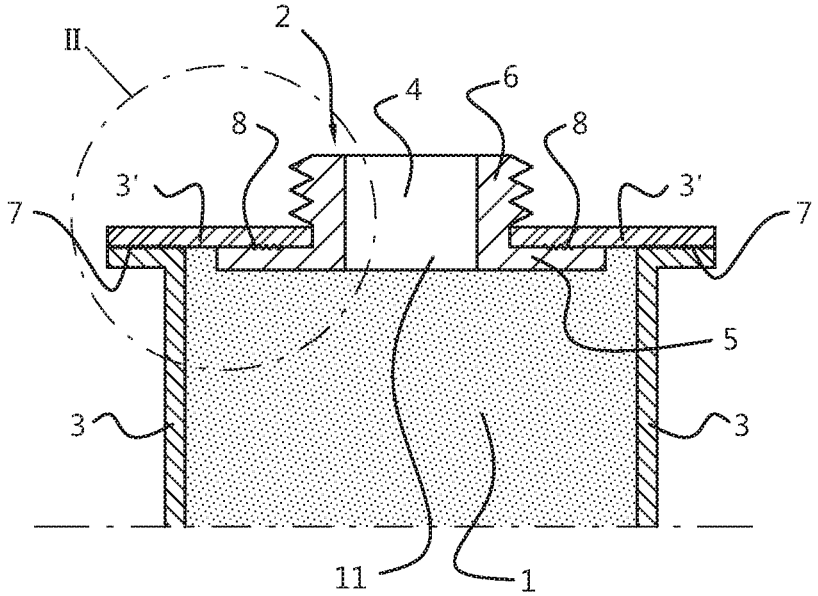

FIG. 1 presents a cross-section of an upper part of a spouted pouch container, produced in a manner that is known from the art. The figure presents a pouch container 1 defining a pouch cavity for storing contents, such as foodstuff. The pouch container 1 comprises one or more side walls 3, a top wall or top cover 3' on the top side of the pouch cavity and a bottom wall (not shown in FIG. 1). The walls 3, 3' may be comprised of one or more layers of wall sheet material, preferably forming one or more films, heat sealed together, folded or molded to envelop the sides of the pouch cavity. Top cover 3' may comprise one or more films or gussets, heat sealed, folded or molded to cover the top side of pouch cavity. The side of side walls 3 and/or top cover 3' facing the pouch cavity may be considered to constitute the interior or inner side of the pouch container. To form the pouch cavity, a sufficiently large portion of the inner side of the side walls 3 is placed against a sufficiently large portion of the inner side of the top cover 3'. The portion of the inner side of the side walls 3 and the portion of the inner side of the top cover 3' can be heat-sealed together to form a seal portion 7 and further to form the shown upper end of the pouch body. What portion is sufficiently large is defined at least in part by the film(s) used and connection strength required. Access to the pouch cavity is obtained via a spout fitment 2. A spout fitment 2 comprises a radial attachment flange 5 and an axial tubular spout part 6 forming a spout passage opening 4 (herein also simply referred to as an opening) that may provide, in combination with a corresponding hole 11 in the top cover 3', access from the outside to the pouch cavity and vice versa. Generally, the (radial) attachment flange extends in a first direction and the (axial) tubular spout part extends in a second direction, the second direction being essentially perpendicular to the first direction.

Spout fitment 2 shares a contact area 8 with the inner side of top cover 3', i.e. on the inside of the pouch body. In the state of the art spout fitment the maximum cross-sectional size is therefore limited by the restricted space available inside of the pouch cavity, more specifically by the space available in radial direction within the pouch cavity at the inner side of the top cover 3'. The space is restricted since top cover 3' has been heat sealed at its circumferential edge to the upper ends of the side walls 3 of the pouch container 1. As to the available space in the pouch cavity, the contact area 8 between the spout fitment 2 and the inner side of the top cover 3' cannot include a part of the top cover 3' that forms part of a seal portion 7, i.e. a portion at which the wall 3 has been sealed to the top cover 3'. Furthermore, the circumferential edge of the radial attachment flange 5 may be in contact with the side wall 3, but in other examples (as shown in FIGS. 1 and 2) there is a gap between the circumferential edge of the radial attachment flange 5 and the inner side of the side wall 3.

A spout fitment 2 can be moved through the above-mentioned hole 11 in the first cover 3' and then suitably be arranged against the inner side of the first cover 3'. This means that the radial attachment flange 5 of the spout fitment 2 is placed against the inner, bottom surface of the top cover 3' while the axial tubular spout part 6 is arranged to extend outwardly through the hole 11 in the top cover 3'. As mentioned above, spout fitment 2 provides for an opening 4 to and from the pouch cavity: the opening 4 allows for access to pouch cavity from the outside so as to fill the pouch container (and therefore may function as a fill opening, while at the same allows the content of a filled pouch container to be discharged.

Figure 2:
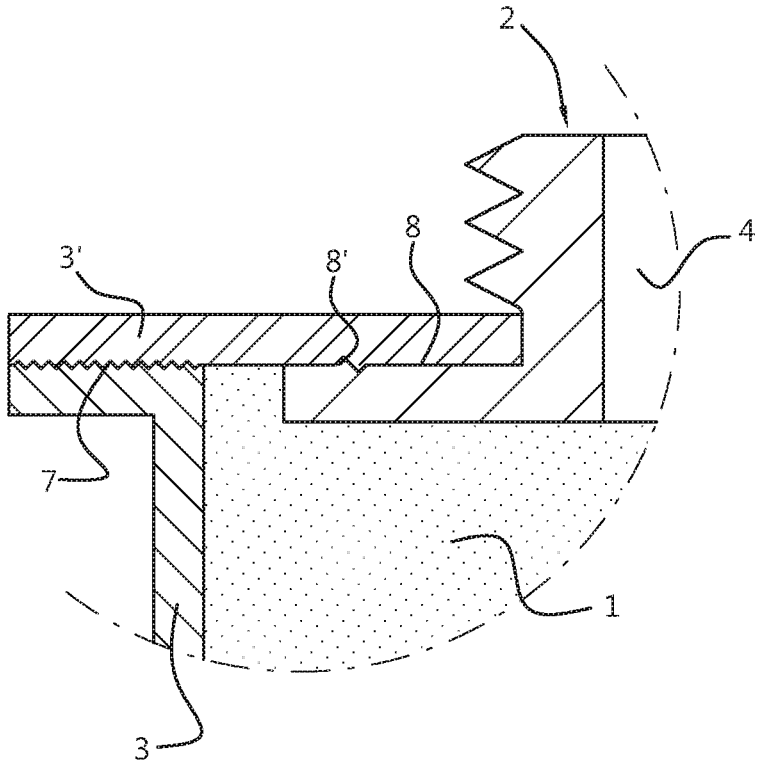

FIG. 2 presents a detail of FIG. 1 where two contact surfaces, the seal portion 7 and a spout fitment seal 8' at the contact area 8, are elucidated. The figure shows that the side of the side wall 3 and/or the top cover 3' facing the pouch cavity may be considered an inner side. To enclose the pouch cavity, a sufficiently large portion of the inner side of the side wall 3 may be placed against a sufficiently large portion of the inner side of the top cover 3'. The portion of the inner side of the side wall 3 and the portion of the inner side of the top cover 3' are then sealed together to form a seal portion 7. The seal portion 7 approximately corresponds in size and position to the contact area between the side wall 3 and top cover 3'.

The radial attachment flange 5 of the spout fitment 2 shares a contact area 8 with the inner side of top cover 3'. Because of this, the width of spout fitment 2 has to be less that the width of top cover 3'. To attach spout fitment 2 to the pouch walls, a joined seal is applied wherein the surface which this takes, is smaller than the contact area 8. A disadvantage of this state of the art manufacturing method is that during the attachment process, the spout fitment 2 should first be moved through the hole 11 of the top cover 3' up-side down and then sealed before being flipped over (i.e. turned over an angle of about 180 degrees) to achieve the standing position as shown in FIGS. 1 and 2. Then spout fitment 2 is welded to the pouch body. Another disadvantage is that spout fitment 2 is attached to the inner side of the pouch container 1 and therefore may get into contact with its contents once it has been filled. Since the spout fitment 2 and especially its connection portion with the top cover 3' may come into contact with the contents of the pouch container 1, special care should be taken to keep the connection portion clean and avoid deterioration of the sanitary quality thereof. For instance, in this prior art example, it can be seen that spout fitment 2 is connected with the joined seal 8' at a peripheral area. The joined seal 8' at the peripheral area is placed close to the outer edge of the contact area 8 between the spout fitment 2 and the top cover 3'. This joined seal 8' is specifically required to prevent unwanted material to leak through the contact area 8 or to stack up in the contact area 8 which is difficult to clean after spout fitment 2 has been placed. Moreover, the location of the joined seal 8' should be as close as possible to the peripheral edge of the attachment flange 5 of the spout fitment 2 in order to minimize the likelihood of unwanted material (for instance, foodstuff contained in the pouch cavity) to accumulate between the top side of the attachment flange 5 of the spout 2 and the bottom side of the first (top) cover 3'. The presence of any unwanted, potentially contaminating materials should be avoided as much as possible to reduce the risk of the unwanted material to cause contamination which could deteriorate the quality of the content of the pouch container 1.

FIGS. 3-13 show several exemplifying embodiments of improved spouted pouch containers according to the present disclosure. Each of the embodiments of the pouch container is comprised of a number walls formed by flexible material, more specifically from wall sheet material. In these figures similar features as the features shown in FIGS. 1 and 2 may have been given like reference numbers and their detailed description may have been omitted here for reasons of efficiency.

The walls of wall sheet material are sealed along their peripheral edges so as to form a pouch cavity for storing contents, such as—not limited to—foodstuff, cleaning stuff like detergent, chemical stuff, health care stuff like body soap or shampoo, medication. To one of the walls, herein referred to as the top wall, a spout fitment is connected to provide a passage between the pouch cavity of the pouch container and the outside world. The spout fitment may close off the pouch cavity, for example by means of a removable cap. The spout fitment is made of plastic material and is relatively stiff (i.e. relative to the flexible wall sheet material). The spouted pouch containers are also shown in FIGS. 13A and 13B, in a flat position and an extended position respectively.

Figure 3:
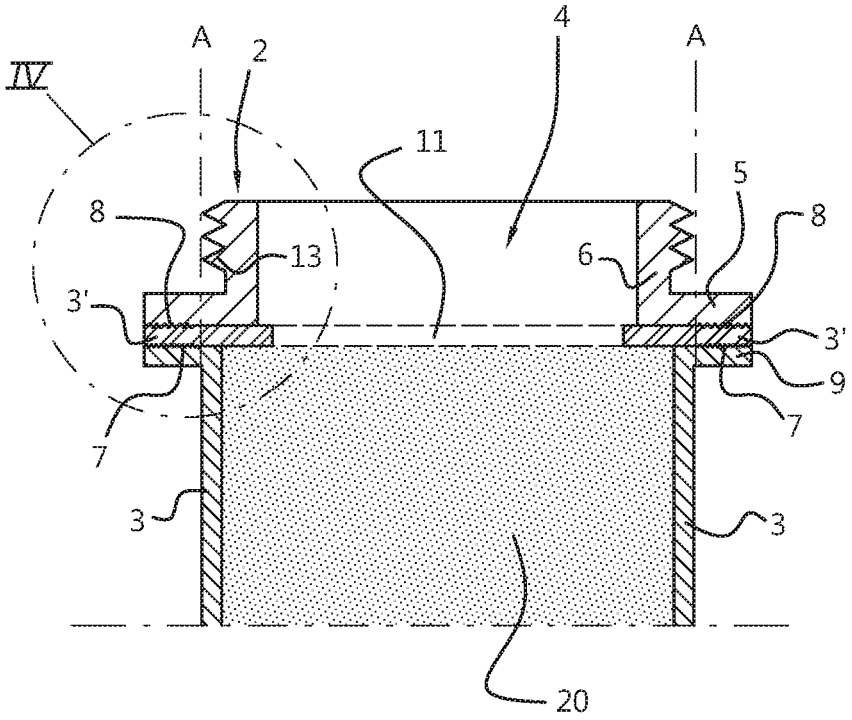
Figure 4:
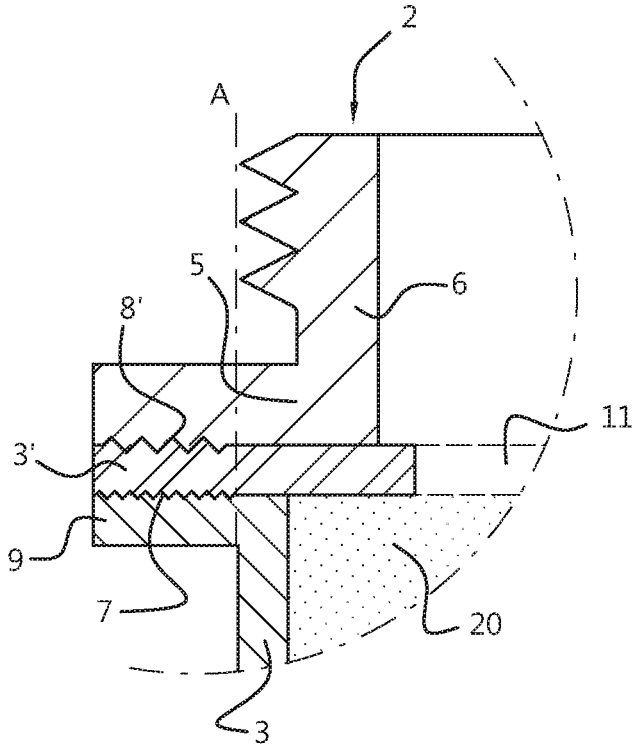

Referring to the embodiment shown in FIGS. 3 and 4, a pouch container 20 is shown comprising two side walls 3, a top wall or top cover 3' and, optionally, a bottom wall.

Figure 13A:
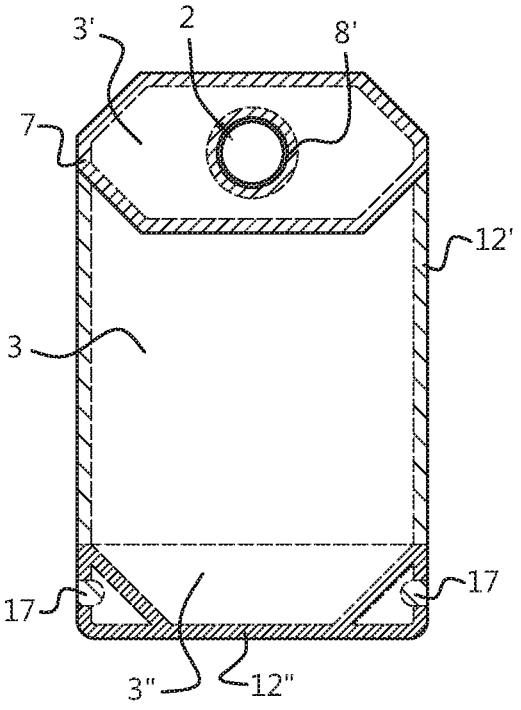
FIGS. 13A and 13B show perspective side views of a preferred embodiment of a spouted pouch, respectively in a flat position and an extended position.
Figure 13B:
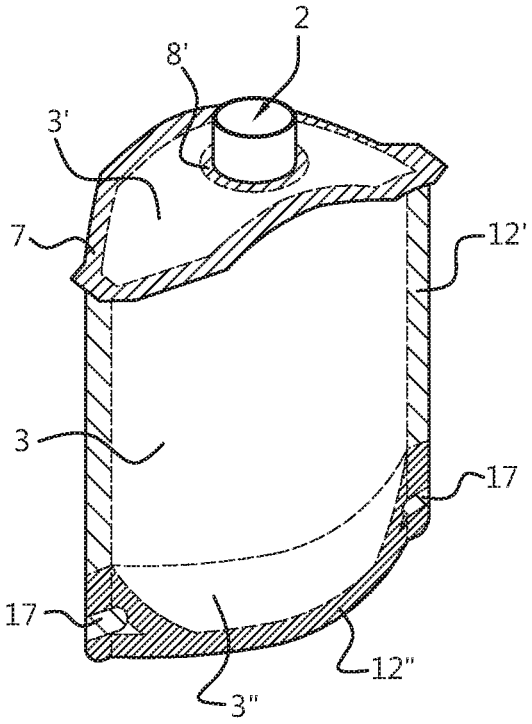

Side wall(s), top wall 3' and/or bottom wall 3" may be comprise of one or more films, heat sealed together, folded and/or molded to envelop the sides of the pouch cavity to form a pouch container 20' (FIGS. 13A, 13B). The top wall or top cover 3' may comprise one or more film gussets, heat sealed, folded and/or molded to cover the top/bottom side of the pouch cavity. That side of the side wall 3, bottom wall 3" and/or top wall 3' which faces the pouch cavity may be considered an inner side. The opposite side of the inner side may be referred to as the outer side.

To enclose the pouch cavity, a sufficient portion of the inner side of the side wall 3 may be placed against a sufficiently large portion of the inner side of the top cover 3'. In the shown arrangement the top cover 3' is attached on top of a folded edge part 9 (cf. FIG. 4) of the side wall 3. The portion of the inner side of the side wall 3 and the portion of the inner side of the top cover 3' can be sealed together to form a seal portion 7. Which portion is sufficient is defined at least in part by the type of film used, and the connection strength required and/or the sealing technique.

Different sealing techniques may be employed, for instance heat sealing, ultrasonic sealing or sealing with adhesive or sealing solvent, depending on the content (to be) filled in the container and/or on the pouch material. When in the present document reference is made to the technique of heat sealing this is to denote a technique also known as heat conductive sealing (HCS). In heat conductive sealing heat is applied to the materials to be sealed (for instance a top cover sealed to a side wall or a spout fitment to a top cover) wherein the heat originates from outside the material to be sealed. At least one of the materials to be sealed is a thermoplastic material and is allowed to temporarily melt as result of the heat conducted thereto. The materials are then pressed together and allowed to cool down. In a direct contact method of heat conductive sealing a heated die or similar heating element in direct contact with at least one of the materials to be sealed applies heat to a specific contact area or path in order to seal or weld the materials together.

In ultrasonic sealing (USS) the heat required for melting is only generated inside the at least one thermoplastic material among the materials to be sealed. Heat is generated by vibration tools contacting the materials to be sealed, by locally vibrating the materials to be sealed so as to cause localized conversion of vibrations to friction heat and to apply a certain pressure to the materials to be sealed. One of the advantages of ultrasonic sealing is that the vibration tools that come into direct contact with the materials to be sealed can remain relatively cold during the entire weld process.

In the embodiment of FIG. 3, the attachment flange 5 of a spout fitment 2 is placed on top of the (outer side of) the top cover 3' of the pouch container 20. The spout fitment 2 has a passage opening 4 allowing access to pouch cavity 1 from the outside of the pouch body to the inside of the pouch body and vice versa. This passage opening 4 can be equipped with any kind of valve or device for flow control.

As can be readily derived from the figure, the size and/or position of the spout fitment 2 when placed on top of the top cover 3' of the pouch container 20 therefore is not limited or less so than the size and/or position when the spout fitment 2 is placed against the inner side of the top cover 3' (cf. FIG. 2). For instance, the size of the spout fitment 2 (i.e. the size in cross-section) can be larger than the space available inside of the pouch cavity. In this arrangement, the contact area 8 between the spout fitment 2 and the outer side of the top cover 3' can include a part of the top cover 3' that is also used (at the opposite side of the cover) as a seal portion 7. Regardless of the shape and size of the spout fitment 2, it may be presumed that it is not in contact with the side wall 3 of the pouch body. A further advantage is that the seal there is no risk of unwanted, potentially contaminating material accumulating between the attachment flange 5 of the spout fitment 2 and the material of the top cover 3' to come into contact with the contents of the pouch container 20, so that the risk of contamination may be reduced. Another advantage is that the joined seal 8' can be positioned anywhere on the contact surface 8 and does not need to be positioned as close as possible to the peripheral edge of the attachment flange 5 of the spout fitment 2. Another advantage is that when spout fitment 2 is to be placed in position, it does not have to go anymore through a hole 11 (pre-) made in the top cover 3'. In several embodiments a hole 11 has been pre-made in the first (top) cover 3'. However, in other embodiments, the spout fitment 2 is secured on its position of top gusset 3' while there it no pre-made hole. In this embodiment, on the outer side of the top cover 3' there might be indicated a first area, for instance indicated by a visual indication like a marker line, which may comprise a distinct color and/or, shape, and/or may be indicated by an embossing. In an additional step the hole can be made after the spout fitment 2 has been attached to the pouch container 20. By making a hole corresponding to the opening 4 in the spout fitment 2 at a later stage, for instance at a moment just before the pouch container 20 is filled with foodstuff, it can be guaranteed more easily that the interior of the pouch container 20 is sufficiently clean. FIG. 4 presents a detail of FIG. 3 where the same two contact surfaces, the seal portion 7 and a spout fitment seal at the contact area 8 of the spouted pouch container 20, are elucidated. The side of the side wall 3 and/or the top cover 3' which faces the pouch cavity may be considered an inner side. To enclose the pouch cavity, a sufficiently large portion of the inner side of the side wall 3 is placed against a sufficiently large portion of the inner side of the top cover 3'. The portion of the inner side of the side wall 3 and the portion of the inner side of the top cover 3' can be heat sealed together to form a seal portion 7. In a possible embodiment, the seal portion 7 approximately equals in size and/or position the contact area 8 between the side wall 3 and top cover 3'. What qualifies a portion as a portion that is sufficiently large is dependent at least in part on the properties of the film used and the connection strength required. Spout fitment 2 shares a contact area 8 with the outer side of the top cover 3'. Because of this, the width of spout fitment 2 can be as large as the top cover 3'. To attach spout fitment 2 to the pouch body, at least one circumferential welded connection is provided where the surface which the welded connection occupies, is smaller than the contact area 8 between the spout fitment 2 and the top (first) cover 3'. In this embodiment it can be seen that spout fitment 2 is connected with a welded connection (joined seal 8') at a peripheral area, more specifically at radial positions next to the circumferential edge of the cover 3'. The joined seal 8' in this embodiment is therefore positioned relatively far from opening 4. This joined seal 8' is arranged to ensure that the spout fitment 2 is connected in a sufficiently firm manner to the pouch body.

More in particular, in an embodiment where spout fitment 2 is to be ultrasonically welded to the pouch body, the area of the joined seal 8' should begin at a radial position further outwardly relative to the axial tubular spout part 6, more specifically more outward relative to the imaginary axial line A (cf. FIGS. 3 and 4) defining the radially outermost position of the (screw thread portion 13 of) the axial tubular spout part 6, so as to provide sufficient space for ultrasonic welding equipment to attach the spout fitment 2 to the top cover 3' of the pouch container 20 using ultrasonic welding.

Figure 5:
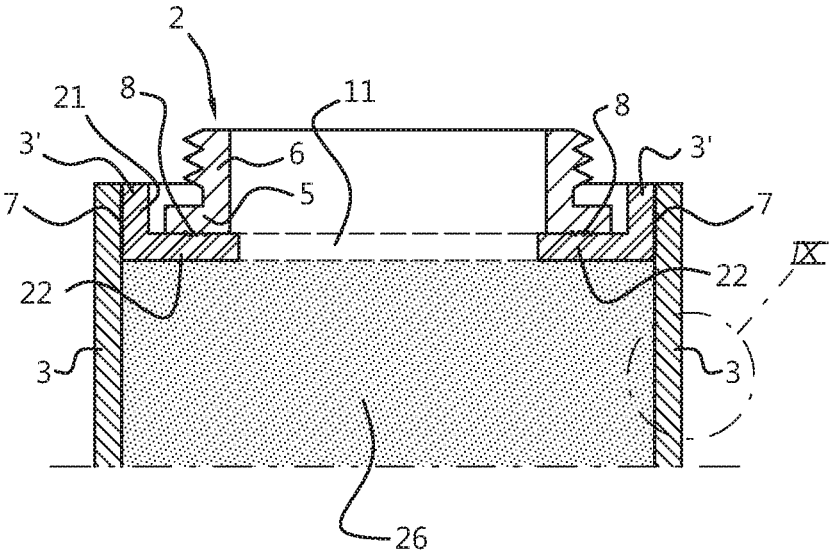

FIG. 5 presents another arrangement in accordance with the present disclosure. A spouted pouch container 26 is presented which may be the result of a method as covered in this document. The spouted pouch container 26 corresponds to the spouted pouch container 20 of FIGS. 3 and 4 except for the manner in which the side wall(s) 3 of the pouch container has been attached to the top cover 3'. While in the arrangement of FIGS. 3 and 4 the top cover 3' is attached to a folded edge part 9 (cf. FIG. 4) of the side wall 3, in the arrangement of FIG. 5 the top cover 3' has been folded to form a folded top cover edge part 21 and a non-folded top cover main part 22 and only the folded top cover edge part 21 of the top cover 3' is attached to the (upper end of the) side wall 3.

Figure 6:
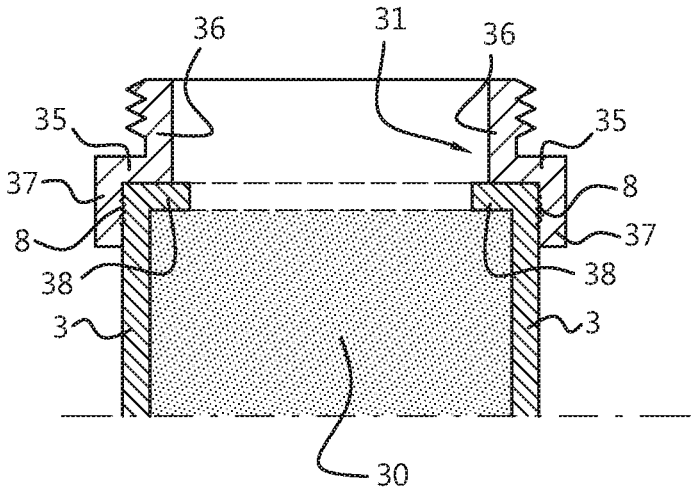

As can be derived from FIG. 5, in the arrangement of FIG. 5, the cross-sectional size of the spout fitment 2 is limited by the width of the non-folded top cover main part 22 of the top cover 3'. In this arrangement, the contact area 8 shared by the radial attachment flange 5 of the spout fitment 2 and the outer side of the non-folded top cover main part 22 of the top cover 3' cannot overlap with the seal portion 7. FIG. 6 presents pouch container 30 corresponding to the earlier described pouch container 20 wherein a different spout fitment 31 is attached directly to the side wall(s) 3 of the pouch container and there is no separate top cover 3'. Similar to the earlier described spout fitment 2, the spout fitment 31 of the present embodiment is formed to have an axial tubular spout part 36 forming a spout passage opening (herein also simply referred to as an opening) that may provide access from the outside to the pouch cavity and vice versa. The spout fitment 31 also comprises a radial attachment flange 35 connected to or integrally formed with the axial tubular spout part 36 and an axial attachment flange 37 connected to or integrally formed with the radial attachment flange 35. At least one of the radial attachment flange 35 and the axial attachment flange 37 are arranged to be connected to an upper end of the outer side of one or more side walls 3 (at one or more contact areas 8) by a suitable sealing technique, for instance by ultrasonic sealing. The upper end of the one or more side walls 3 of the pouch container 30 may have a folded circumferential edge 38 as is shown in FIG. 6. In other arrangements, however, the upper end of the one or more side walls 3 is not folded and the side walls 3 are only connected to the axial attachment flange 37.

The size of the spout fitment 31 in the present arrangement is not limited by the space available inside of the pouch cavity. Due to the fact that there is no top cover 3' it is not required in this arrangement to make a hole 11 or opening at the upper end of the pouch container 30: the passage (opening) 4 in the axial tubular spout part 36 is directly in fluid connection with the container cavity.

Figure 7:
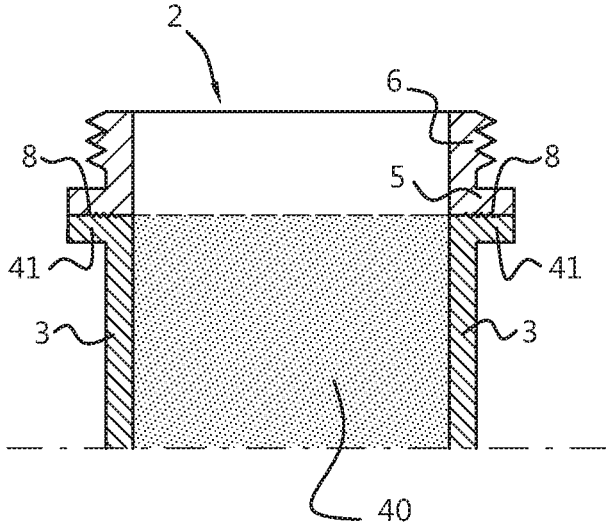

FIG. 7 presents a further arrangement of a pouch container 40 manufactured according to a method according to the present disclosure. In this embodiment the pouch container 40 comprises a spout fitment 2 as described in connection with the embodiments of any of FIGS. 3-5 that is attached directly to an outwardly folded circumferential edge portion 41 of the one or more side walls 3. Similar to the embodiment shown in FIG. 6 the FIG. 7 arrangement does not have a top cover 3'. The diameter of the spout fitment 2 may be larger than the diameter of the space available inside of the pouch cavity.

Figure 8:
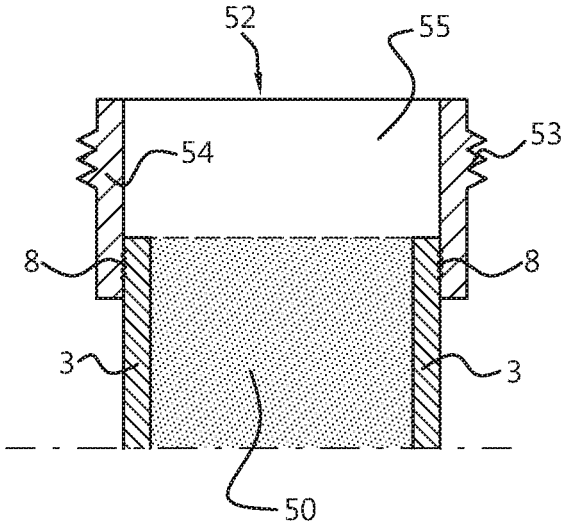

FIG. 8 presents an arrangement of a pouch container 50 similar to the earlier arrangements, wherein different spout fitment 52 only comprised of an axial tubular spout part 54 is directly attached to the outer side of the upper circumferential edge of the one or more side walls 3. In this embodiment a top cover 3' can be dispensed with and the passage opening 55 of the axial tubular spout part 54 directly connects to the interior of the pouch container 50 (i.e. to the pouch cavity). The outer surface of the axial tubular spout part 54 is provide with a threaded portion 53 to allow a closing cap to be removably mounted to the axial tubular spout part 54.

Figure 9:
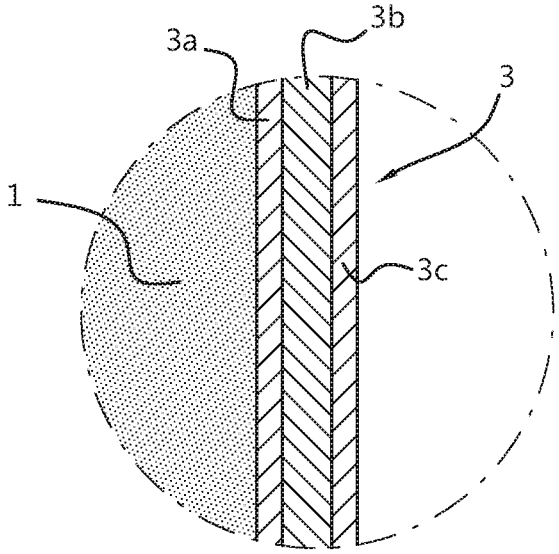

FIG. 9 shows a cross-section of a side wall 3, top wall 3' and/or bottom wall 3" in accordance with any of the arrangements presented in FIGS. 3-8, for instance the side wall 3 of FIG. 5. Although each of the side wall(s) 3, top wall/cover 3' and bottom wall 3" may consist of a single-material such as a single film, they usually comprise a plurality of layers or films. FIG. 9 shown an example of a multi-layer film wall 3, 3', 3" (more precisely, a three layer wall. In the particular example of FIG. 9 the wall has three layers (3*a*, 3*b*, 3*c*). However, the number of layers could be lower or higher, depending amongst others on the intended use of the pouch container. The layers may have different physical properties.

The inner layer 3*a* of this example may comprise any first material as long as it sufficiently fulfills the requirements for the inner layer of the pouch. Examples of such additional requirements are; for the material to not affect the content which the spouted pouch container is to be filled with; to be sufficiently flexible, durable, resistant to heat and/or cold; to be water proof; and to have favorable heat seal characteristics. The inner layer (3*a*) of this example may be comprised of polyolefin like PE or PP.

The middle layer 3*b* of this example may comprise any second material which sufficiently fulfills the requirement for the middle layer of the pouch. Examples of such additional requirements are; for the material to add the feature of light shielding; to provide a non-water or gas permeable layer, printing of design or indication or the like.

The outer layer 3*c* of this example may comprise any third material which fulfills the requirements for the outer layer of the pouch, including being printable or having a naturally robust look. Additionally, the outer layer 3*c* may comprise a material which may be used in the ultrasonic welding so that the outer layer 3*c* and the spout fitment 2, 31, 52, 58 may be sealed to each other. To this end, the first material which the outer layer 3*c* is formed of, should contain more than 50% of a specific material, for example, polyethylene terephthalate (PET) or a polyolefin, preferably PE or PP. The spout fitment can be formed by a material which may comprise the same material as the first material of the outer layer 3*c*, for example the spout fitment may be formed by a second material containing more than 50% of the same specific material as present in the first material used for the outer layer 3*c*, in order to obtain a sufficiently strong welding connection. Less than 50% may sometimes not provide sufficient welding strength. This may allow for the use of ultrasonic sealing to weld the spout fitment 2, 31, 52 to the outer layer 3*c*. Ultrasonic welding can be applied directly to the spout fitment 2, 31, 52 to seal to the outer layer 3*c*, which means that the spout fitment 2, 31, 52 only needs to be placed on top of the outer layer 3*c* and that ultrasonic vibrations can be applied right after placement of the spout fitment. Furthermore, an ultrasonic welding process also has the advantage that it can be controlled easily and/or that the risk of damage to the material of the top wall 3' or the spout fitment 2, 31, 52 is minimal. Alternatively or additionally, a heat sealing process can be applied. For instance, heat sealing can be applied to the spout fitment 2, 31, 52 to seal to the outer layer 3*c* with suitable heating temperature and time which on the one hand does not melt the spout fitment 2, 31, 52 and on the other hand gives enough sealing strength at the contact area 8. Care should be taken not to damage the (outer layer 3*c* of) the top wall 3' if heat is applied through the relatively thick material of the spout fitment 3, 31, 42.

The direction from which the ultrasonic vibrations are applied is from above. Therefore the spout fitment 2, 31, 52 does not have to be conveyed in an up-side down position as was the case if the spout fitment was to be placed inside of the pouch container as described in connection with the prior art examples of FIGS. 1 and 2. Alternatively, the film as exemplified can be heat sealed to one or more other films by placing areas of the films against each other and exposing the films to a minimum level of heat for a minimum duration of time. The areas which are fitted together are considered to together form the seal portion.

Figure 10:
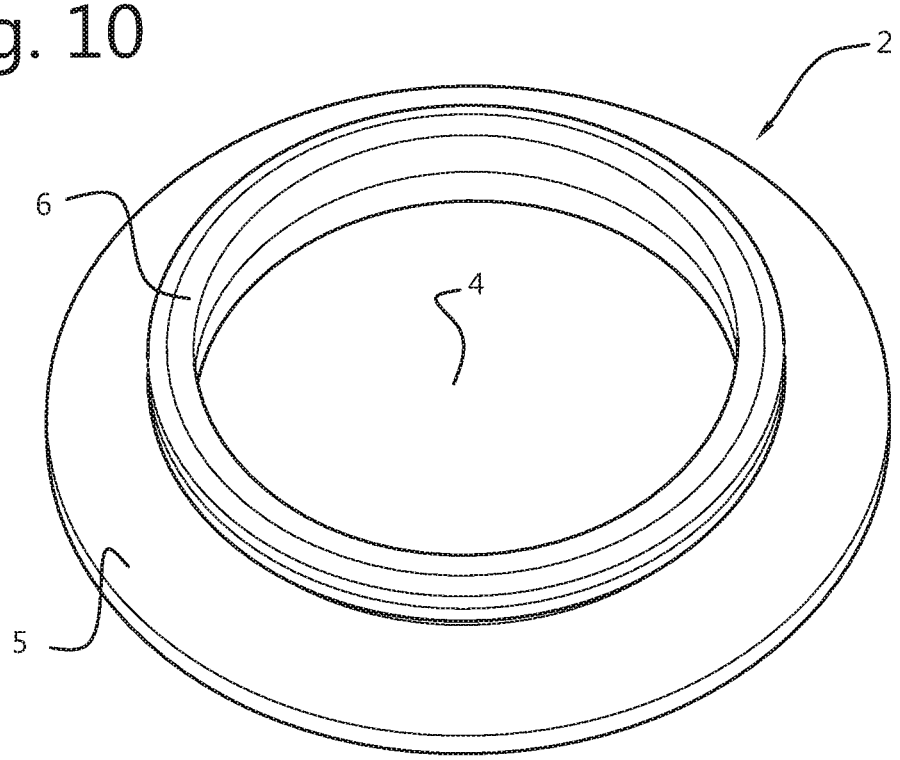
Figure 11:
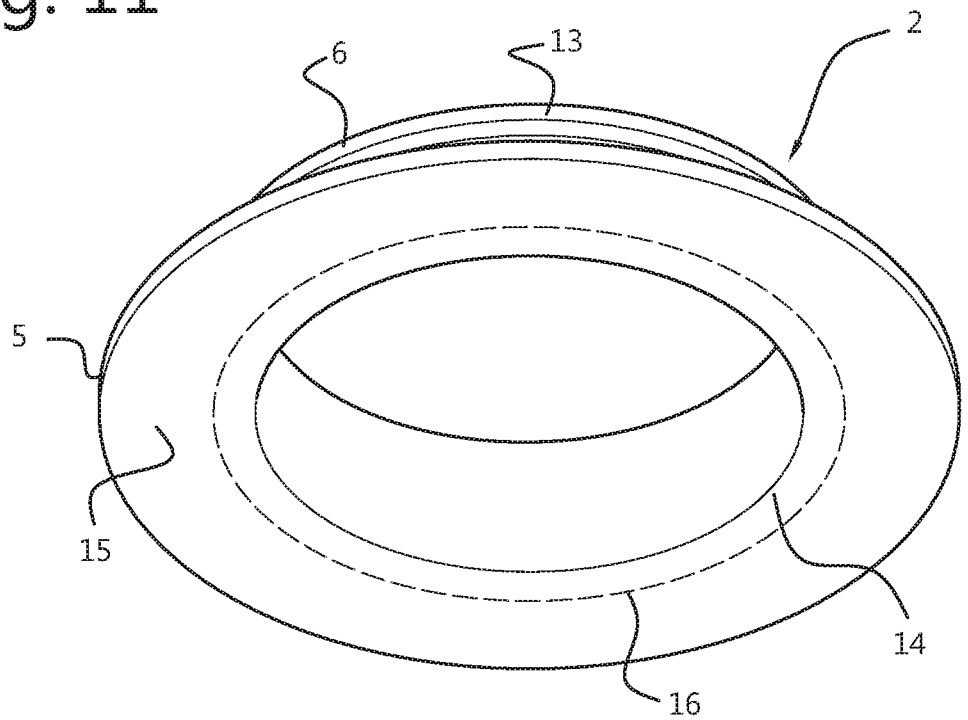

FIGS. 10 and 11 respectively show a top view and a bottom view of an exemplifying embodiment of the spout fitment 2 of FIGS. 3-5. The spout fitment 2 comprises a ring-shaped radial attachment flange 5 and a cylindrical axial tubular spout part 6. The outer surface of the cylindrical axial tubular spout part 6 comprises a threaded part 13 so as to allow attaching a closure (not shown), for instance a screw cap. The threaded part 13 can be a single-piece with the spout fitment 2 or another piece than the spout fitment 2. The outer surface of the cylindrical axial tubular spout part 6 can comprise a different type of structure which can be connected to any type of cap, for example, a hinge cap, non-threaded cap or a single-piece cap with the spout fitment 2. In this embodiment, the parts 5 and 6 of the spout fitment 2 are molded to form a single body. Materials considered for this purpose may comprise a specific material, which may be polyolefin or PET, and preferably is PE. This material need to comprise more than 50% of this specific material which is the same as the specific material which is included for more than 50% in the outer layer 3*c* of the films. A person skilled in the art can foresee that in other embodiments the ring-shaped radial attachment flange 5 and the cylindrical axial tubular spout part 6 can be produced separately and attached to one another to form a spout fitment 2 in a later process.

Although the ring-shaped radial attachment flange 5 is shaped to have circular peripheral edge, the flange 5 may be also be shaped differently, for instance a polygonal shape or a shape having a cut out portion on its peripheral edge to allow for easy handling during the manufacturing process. In the shown embodiments the radial attachment flange 5 extends at a right angle relative to the axial direction of the axial tubular spout part 6. However, in other embodiments the radial attachment flange extends obliquely relative to the axial tubular spout part. The side of base segment 5 opposite of where axial tubular spout part 6 is connected to base segment 5 can be referred to as the bottom side of spout fitment 2 and is divided in a center area 14 and a peripheral area 15. Center area 14 is defined as the surface of the bottom side which starts at the inner edge of base segment 5 and stretches outward up to a border 16. The border 16 is aligned with the outer edge of the axial tubular spout part 6 and described as line (A) in the FIGS. 3 and 4. Peripheral area 15 is defined as the surface from the bottom side which starts at the outer edge of the radial flange 5 and stretches inward up to the border 16.

To attach spout fitment 2 to a pouch body while spout fitment 2 is arranged on the outside of the pouch body, equipment to perform ultrasonic welding is positioned at least partly above the top of the base segment 5. At least a single joined seal is made which can be positioned outside of the center area 14. In embodiments of the present disclosure two or more sets of joined seals can be made for a stronger welding result. More specifically, the sets of joined seals can be placed outside of the center area 14 and in the peripheral area 15. The joined seal performed on the peripheral area 15 is not always necessary but can reduce the likelihood of the unwanted presence of a space between the bottom side of the spout fitment 2 and the top side of the top cover 3' thereby reducing the risk of dirt accumulating between the spout fitment 2 and the top cover 3'.

Figure 12:
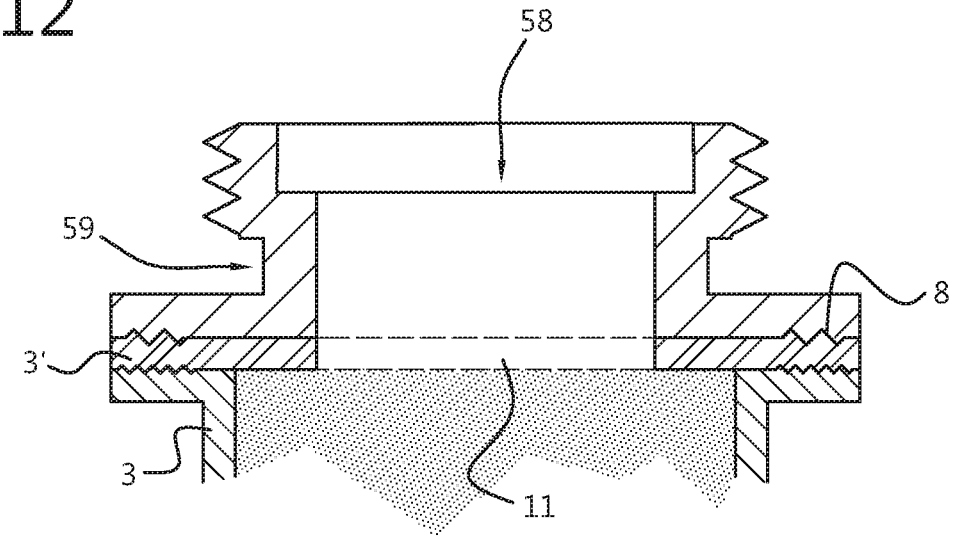
FIG. 12 is a cross-section of an upper part of a further embodiment of a spouted pouch container, manufactured in accordance with the present manufacturing method.

FIG. 12 presents another embodiment of a spout fitment 58. The spout fitment 58 corresponds to the spout fitment of FIGS. 3-5 except that the axial tubular spout part has a neck portion 59 formed as an indentation. The neck portion 59 can be used to allow a suitable grip on the pouch container. However, the manner of attachment of the spout fitment 48 to the one or more walls 3 of the pouch container is the same.

FIGS. 13A and 13B are side views of an embodiment of a pouch container made in accordance with the present disclosure, respectively in a flat position and an extended position respectively. The spouted pouch container comprises top cover or top wall 3' to which spout fitment 2 is attached by one or more joined seals 8'. The pouch body further comprises two side walls 3 and a bottom wall or gusset 3". The side walls 3 have been connected to the top wall 3' by one or more seal portions 7, the side walls 3 have been connected to each other by seal portions 12' and the side walls 3 have been connected to the bottom wall 3" by one or more seal portions 12", The flat position of FIG. 13A is the position directly after the manufacturing method described hereafter, while the extended position of FIG. 13B represents the pouch container in use (for instance, when filled with content, like foodstuff).

In the next section several embodiments of a method of manufacturing spouted pouch containers (cf. FIGS. 14A-26) and an apparatus for manufacturing spouted pouches (FIG. 27) will be described in detail. The spout fitments 2, 31, 52, 58 to be applied to the pouch container may belong to any of the types of spout fitments described herein. However, for ease of description, the apparatus and method are now described in connection with the spout fitment 2 specifically shown in FIG. 3, for instance.

Figure 14A:
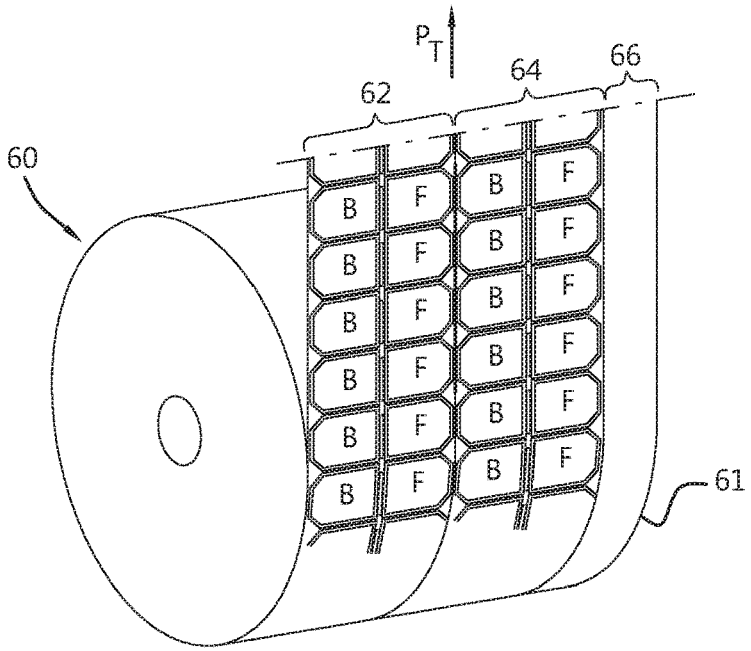
FIG. 14A is a side view in perspective of a first roll of base material for manufacturing a spouted pouch container in accordance with the present disclosure.
Figure 28:
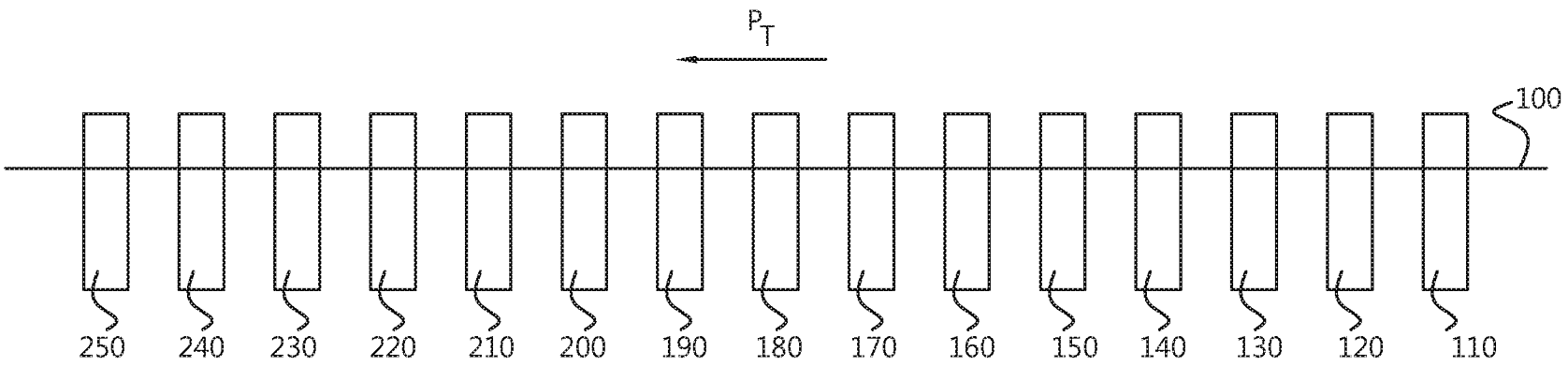
FIG. 28 is a schematic view of an embodiment of an apparatus for manufacturing pouch containers.

FIG. 14A shows a first roll 60 of wall sheet material 61 for forming a large number of pouch containers. The wall sheet material 61 comprises a mono-layer film or multi-layer film that is carried on a conveyor 100 (cf. FIG. 28) configured to transport the wall sheet material 61 in a transport direction $P_T$. The wall sheet material 61 on the first roll 60 comprises a first part 62 intended to constitute a first strip 63 intended to form the front side walls 3' (herein also referred to as front walls F) and back side walls 3' (herein also referred to as back walls B) of a number of pouch containers, a second part 64 intended to constitute a second strip 65 intended to form the front side walls 3' (herein also referred to as front walls F) and back side walls 3' (herein also referred to as back walls B) of the pouch containers, and a third part 66 intended to form a bottom strip 67 intended to form the bottom walls, more specifically the bottom gussets 3", of the pouch containers. Throughout the following figures the intended inner sides of the first, second and bottom strips 63, 65, 67 (i.e. the sides facing the interior of the pouch container) are also denoted by 63A, 65A, 67A, respectively. Similarly, the intended outer sides of the first, second and bottom strips 63, 65, 67 are denoted by 63B, 65B, 67B, respectively.

Figure 14B:
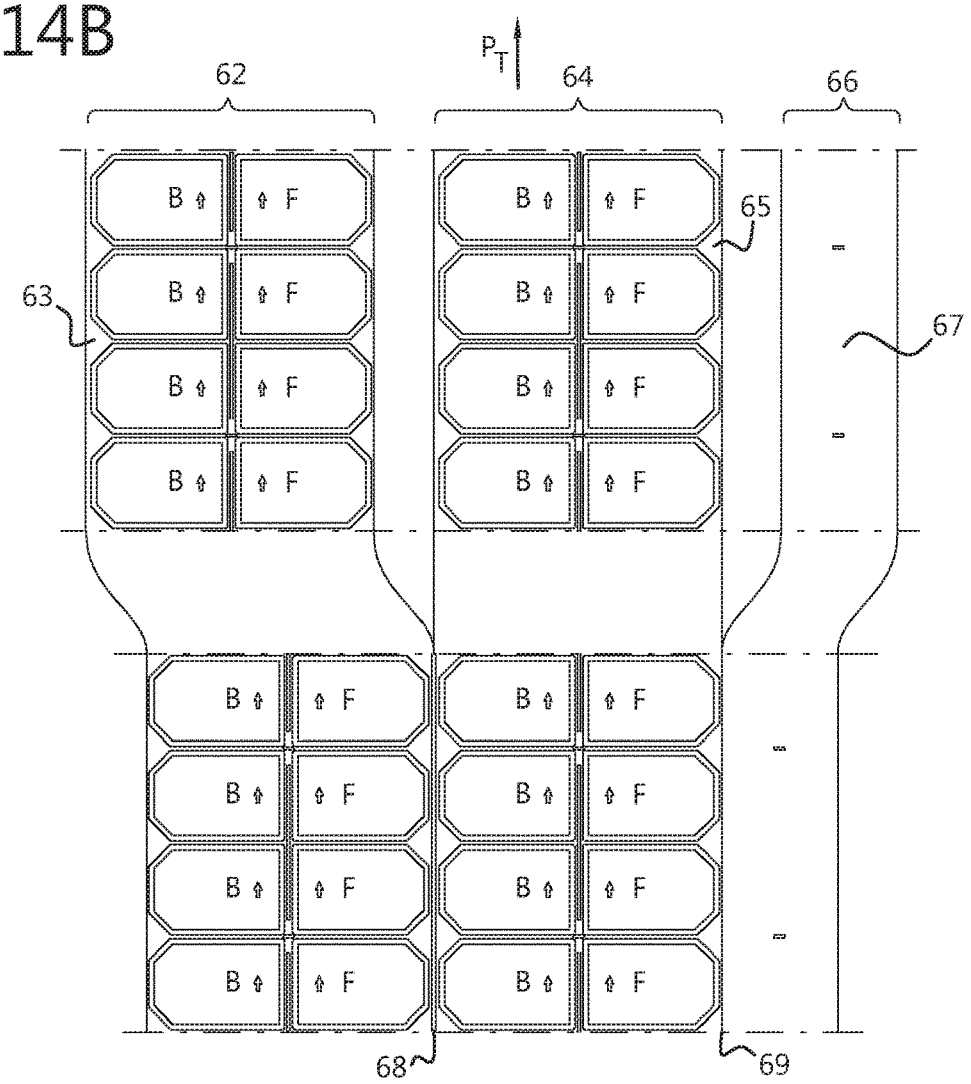
FIG. 14B is a side view of the first roll of FIG. 14A, further showing the cutting of the base material in various strips of material.

FIG. 14B shows the wall sheet material 61 in more detail and also shows how the three parts 62, 64, 66 of the wall sheet material 61 from the first roll 60 (see lower part of FIG. 14B) are separated to form the strips 63, 65, 67, respectively (shown in the upper part of FIG. 14B). The parts 62, 64, 66 are separated by transporting the wall sheet material 61 along one or more cutting elements, for instance cutting knives (not shown), arranged in a first separation unit 110 (cf. FIG. 28), and by cutting the wall sheet material 61 along respective cutting lines 68 and 69 (cf. bottom part of FIG. 14B). Once the strips 63, 65, 67 have been formed, they are further transported by the conveyor 100 in the transport direction $P_T$.

Figure 15B:
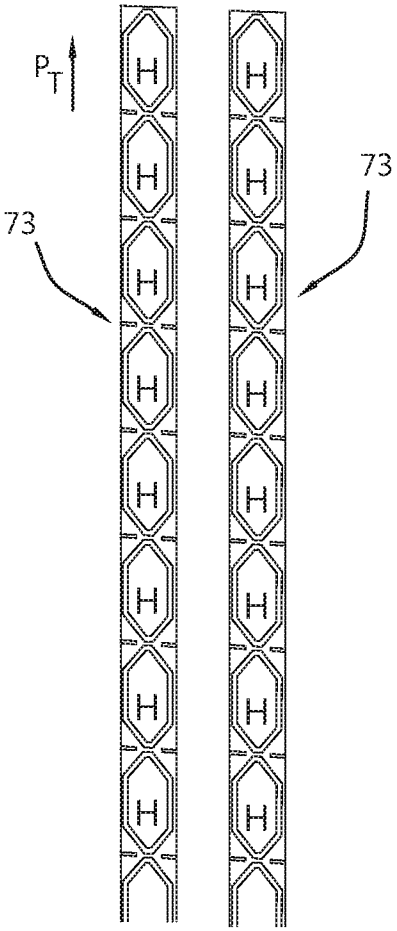
FIG. 15B is a side view of the second roll of FIG. 15A, further showing the cutting of the base material in two strips of material.
Figure 15A:
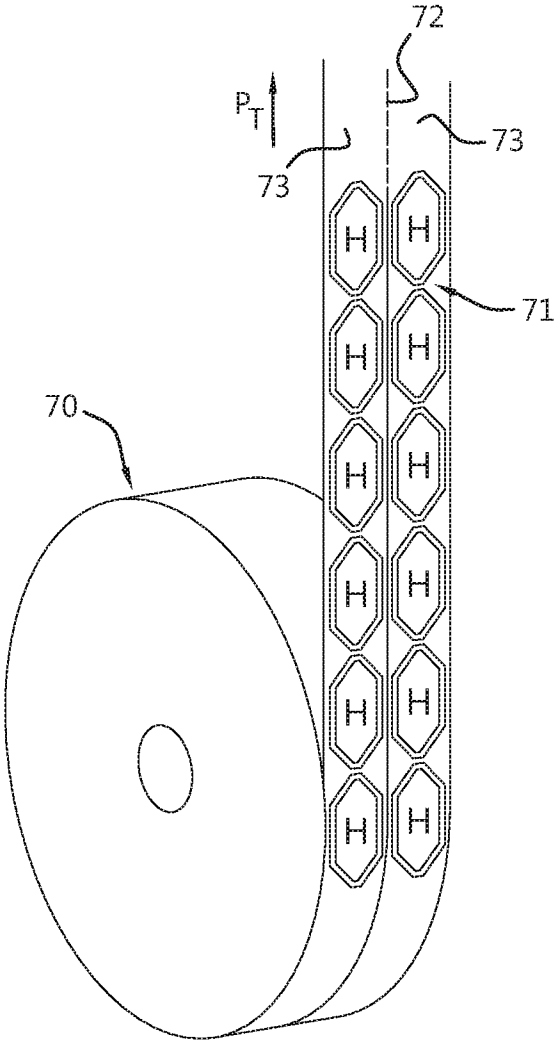
FIG. 15A is a side view in perspective of a second roll of base material for manufacturing a spouted pouch container in accordance with the present disclosure.

FIGS. 15A and 15B respectively show a second roll 70 of further wall sheet material 71 for forming the top walls or top covers 3' of the pouch containers to be formed from the wall sheet material 61 of the first roll 60. The further wall sheet material 71 is formed by the same mono-layer film or multi-layer film as the wall sheet material 61 of the first roll or by a different mono-layer or multi-layer film. The further wall sheet material 71 is carried on the same conveyor 100 in a transport direction $P_T$, preferably alongside the wall sheet material 61 of the first roll 60, as will be explained hereafter Similar to the wall sheet material 61 on the first roll 60 the wall sheet material 71 is separated in the first separation unit 110 (or in another separation unit) in two separate strips of top cover material (herein referred to as top cover strips 73) by cutting the wall sheet material along a cutting line 72 (cf. FIG. 15A), to arrive at the arrangement of FIG. 15B. Once the two top cover strips 73 have been formed, they are further transported by the conveyor 100 in the transport direction $P_T$.

Figure 16:
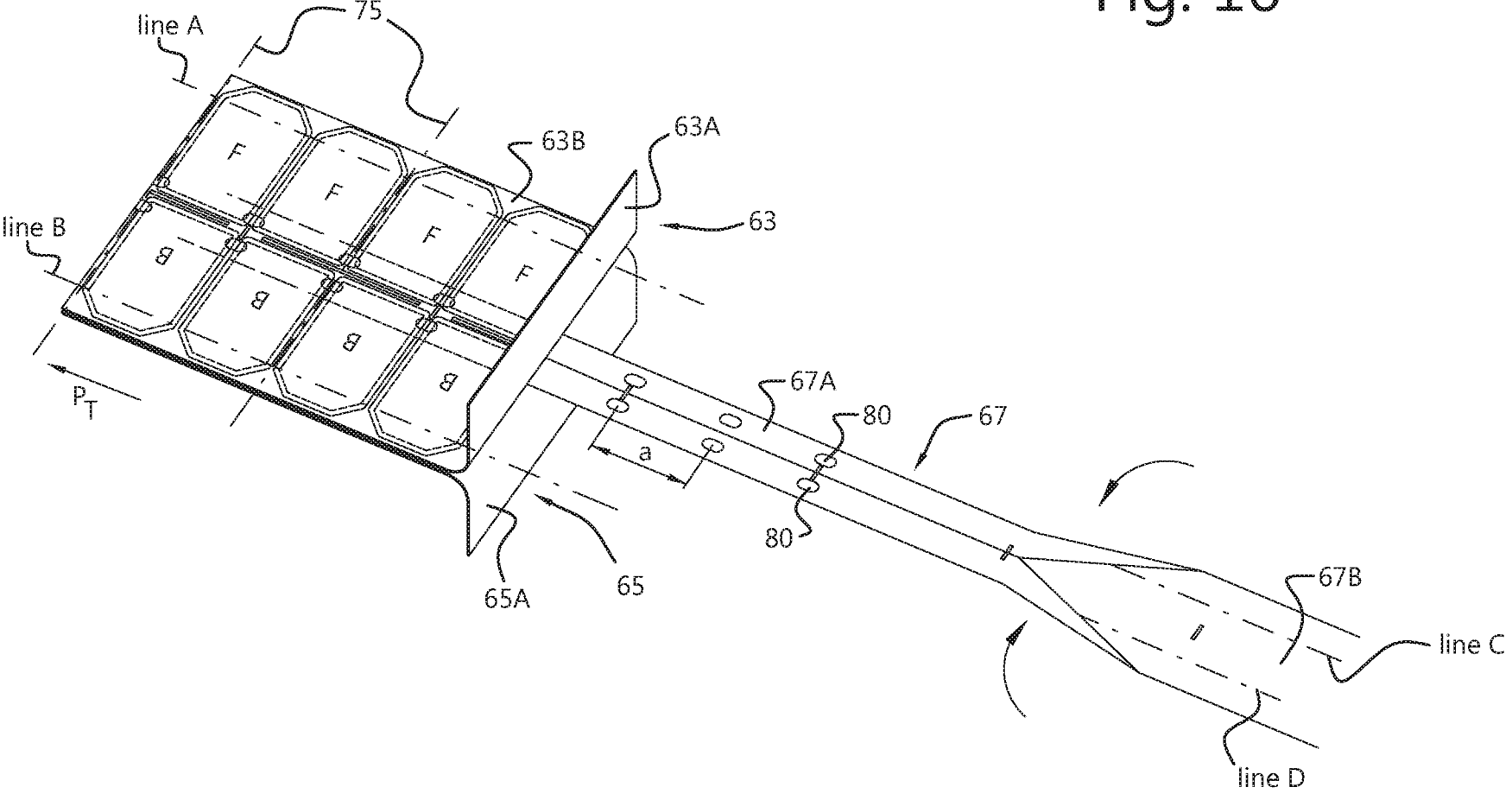
FIGS. 16-27 are views showing various steps of an example of a manufacturing method.
Figure 17:
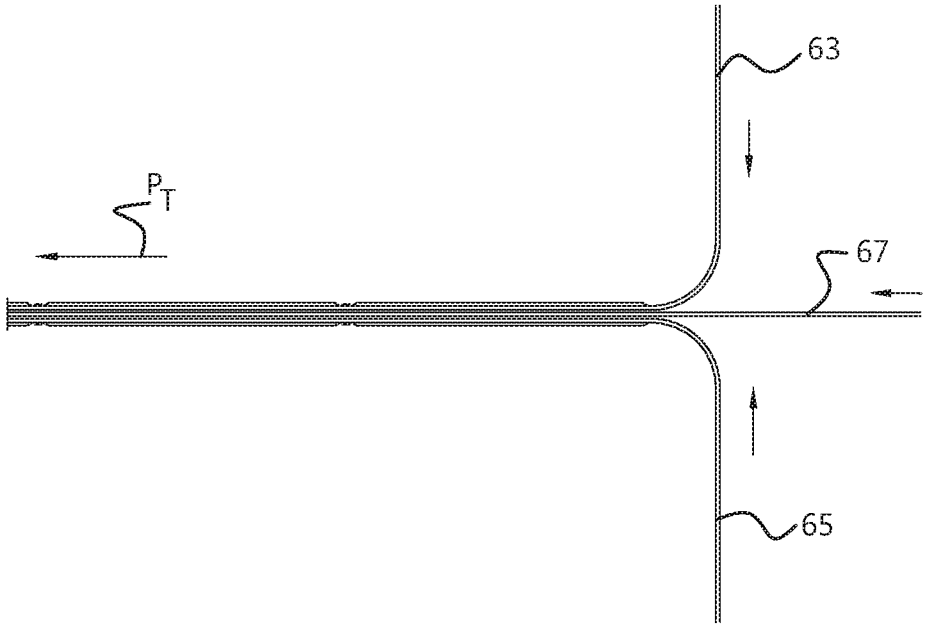

FIG. 16 shows that the bottom strip 67 arriving from the roll 60 in a flat shape (see right hand side of the figure) and being transported in transport direction $P_T$ is folded in a first folding unit 120 into a flattened tubular shape (see the centre part of the figure). The side of the bottom strip 67 that is to form the inner side of the bottom of the pouch container is denoted by 67A, while the opposite side of the strip (i.e. the side that is to face the exterior) is denoted by 67B. The bottom strip 67 is then provided in a first perforation unit 130 with a number of perforations 80 provided at equidistant positions relative to each other in the longitudinal direction of the strip 67 (wherein the distance a between consecutive perforations 80 corresponds to the width of a pouch container, as will become clear from the following description). The function of the perforations 80 is to allow a certain part of the wall sheet material of the wall portion to be sealed to each other at the point seal part 17 in order to make the pouch stand up right in the extended position.

Referring to FIG. 16, in a further step performed by a handling unit 140, the separated first strip 63 and second strip 65 are brought together (see also the schematic side view of FIG. 17 wherein this step is elucidated) and moved in a parallel orientation in transport direction $P_T$ while the bottom strip 67 is moving at the same speed and is arranged (sandwiched) between the (upper) first strip 63 and the (lower) second strip 65.

Referring to FIG. 16, in a further step performed in a first seal press unit 150, the first and second strips 63,65 are welded to the bottom strip 67 along a number of transverse welds 75 extending perpendicularly to the longitudinal direction (i.e. the transport direction $P_T$) of the strips.

Figure 18:
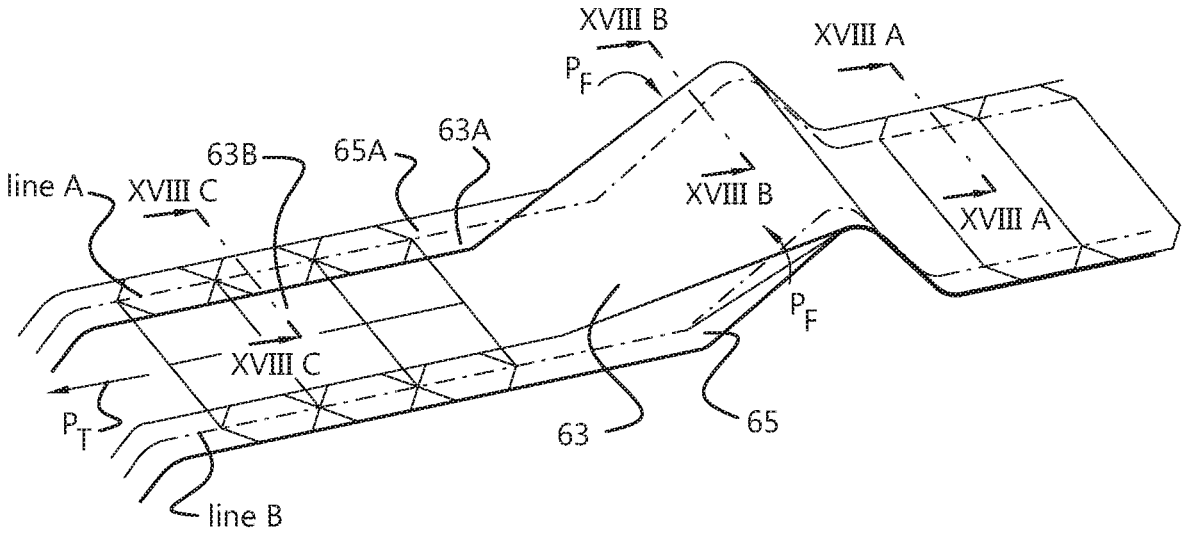
Figure 18A:
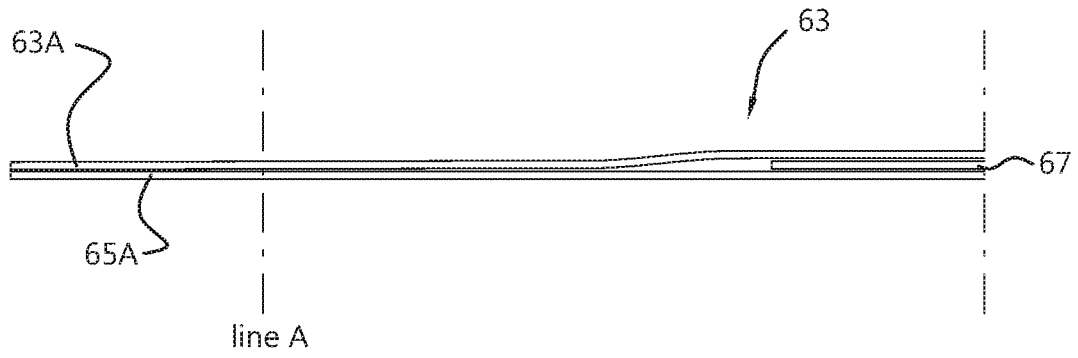
Figure 18B:
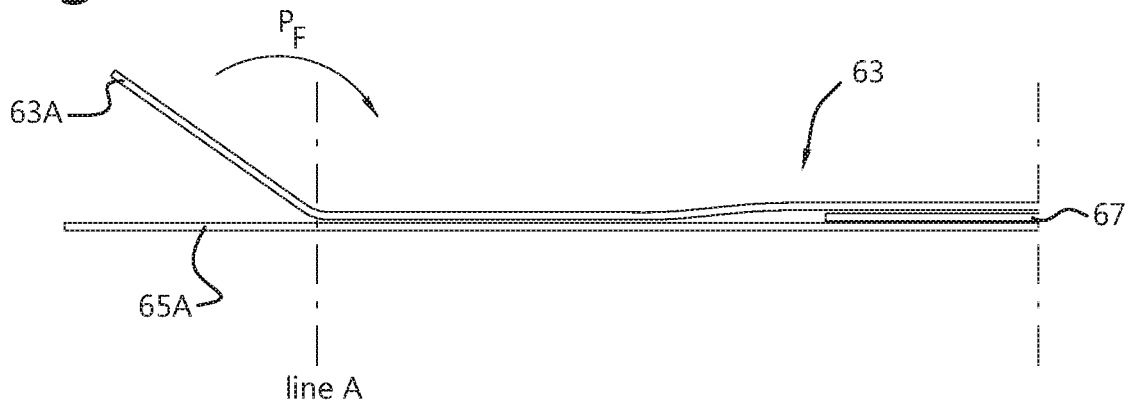
Figure 18C:
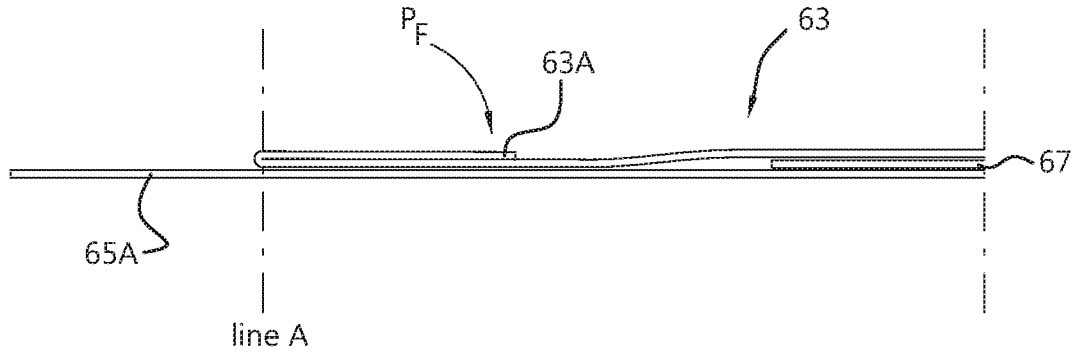

FIG. 16 also shows two imaginary longitudinal lines A and B. These lines denote the fold lines along which the (upper) first strip 63 of wall sheet material is folded in a further step, as is shown in FIG. 18. FIG. 18 shows the steps of folding the two longitudinal edge parts of the (upper) first strip 63 of wall sheet material inwardly as indicated by arrows $P_F$. The steps have also been shown in the more schematic views of FIGS. 18A, 18B and 18C.

The steps are performed by a (second) folding unit 160 while the strips 63, 65, 67 are being transported on the conveyor 100. The second folding unit 160 is configured so that a longitudinal edge part of the first strip 63 (cf. FIG. 18A) is folded over about 180 degrees (cf. FIGS. 18B, 18C) to arrange those parts of first strip 63 outside of line A in such a manner that intended inner side (63A) is facing away from the second strip 65. This results at the same time in a part of the intended inner side (65A) of the second (lower) strip 65 to become exposed, in the sense that does not have the intended inner side (63A) of the first strip opposite to it. In the same manner those parts of the first strip 63 outside of line B is folded in such a manner that intended inner side (63A) is facing away from the second strip 65.

Figure 19:
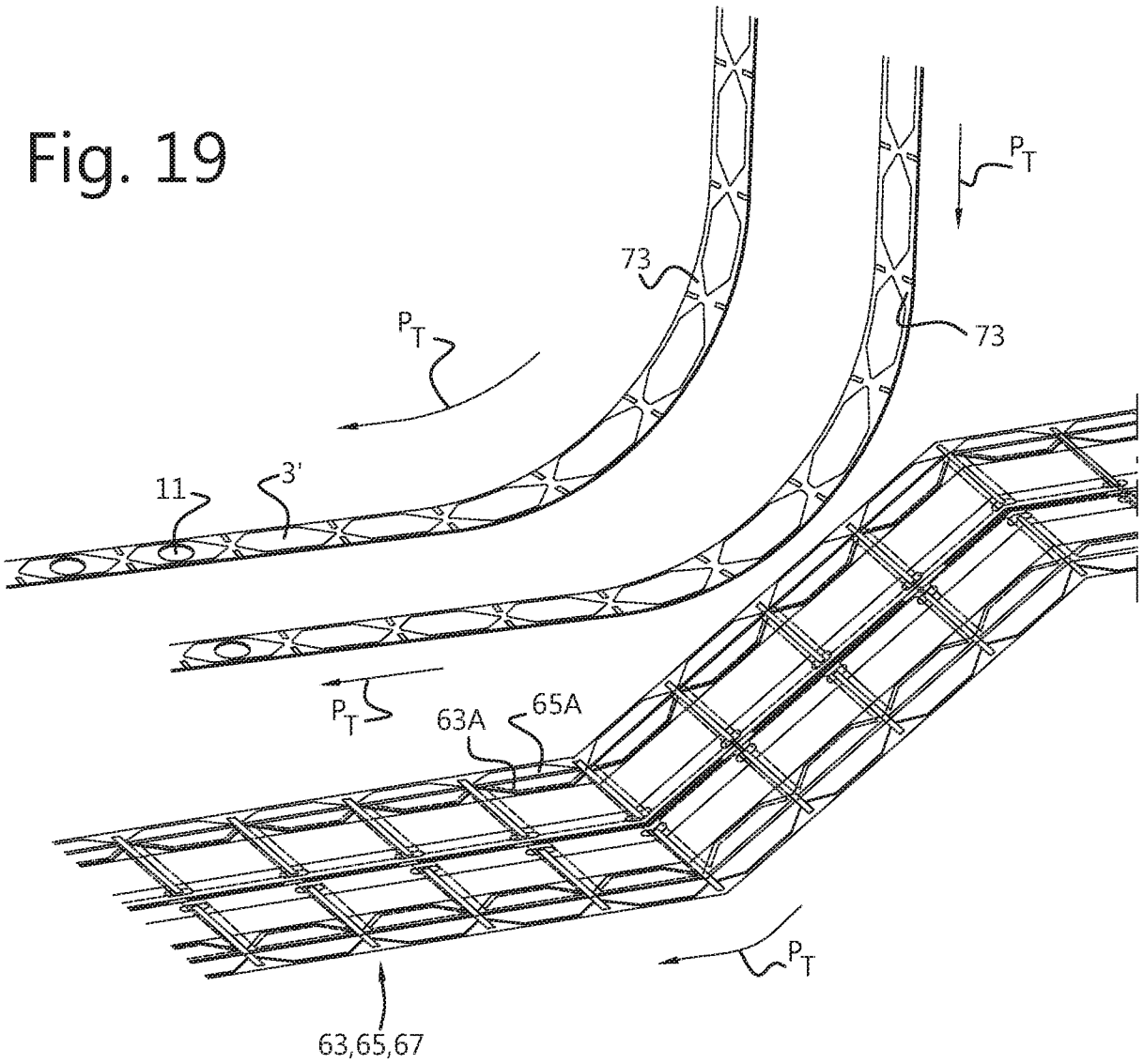

Referring to FIG. 19, in next method steps, the two cover strips 73 (cf. FIG. 15A, 15B) are transported with the same speed as the assembly of the first, second and third strips 63, 65, 67 (the first and second strips being welded to the third strip). In the shown embodiment a number of holes 11 are made in each of the cover strips 73 by a second perforation unit 170, although in other embodiments use is made of pre-holed cover strips or cover strips wherein the holes are made in a later stage, for instance right before a filling station for filling the pouch container with content. In the latter case the intended positions of the holes could be considered to represent intended holes. Spout fitments, for instance spout fitments 2, are then placed in placement unit 180 on top of each of the two cover strips 73, preferably at positions such that each passage opening 4 of the spout fitment corresponds in size and location to an (intended) hole 11 in the cover strip 73. The placement unit (180) comprises a seal section (not shown) that is configured to seal the spout fitments 2 to the cover strip 73. Preferably the seal section is configured to attach the spout fitment 2 to the upper surface of the cover strip 73 by ultrasonic sealing.

Figure 20:
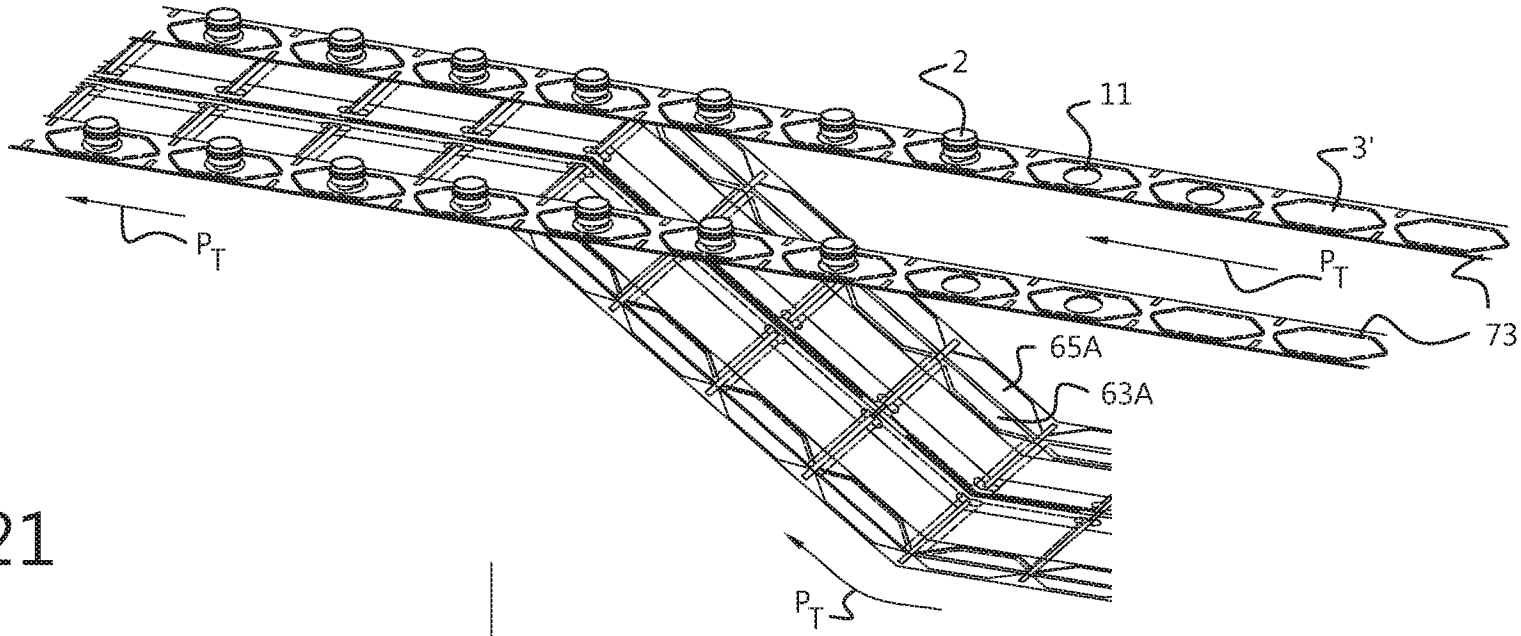
Figure 21:
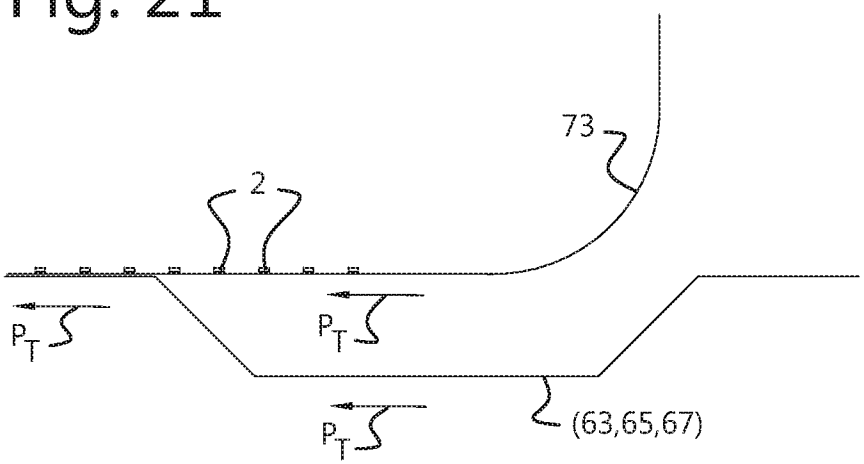

Referring to the side view in perspective of FIG. 20 and the corresponding schematic side view of FIG. 21, the spouted strips 73 moving in transport direction $P_T$ on the conveyor 100 are then joined with the assembly of strips 63, 65, 67 moving on the same conveyor 100 and the spouted strips 73 are positioned by the conveyor 100 on top of the longitudinal edge of the first and second strips 63, 65 of the assembly. More specifically, referring to FIG. 18, a spouted strip 73 is placed on the intended inner side 65A of the second strip 65 and on the intended inner side 63A of the first strip 63. Furthermore, the spouted strips 73 are moved to place each portion of a spouted strip 73 that is to form a top cover 3' of a spouted pouch container, exactly on the corresponding inner sides of the front (side) wall 3 and the back (side) wall 3, as is shown in the left-hand side of FIG. 20.

Figure 22:
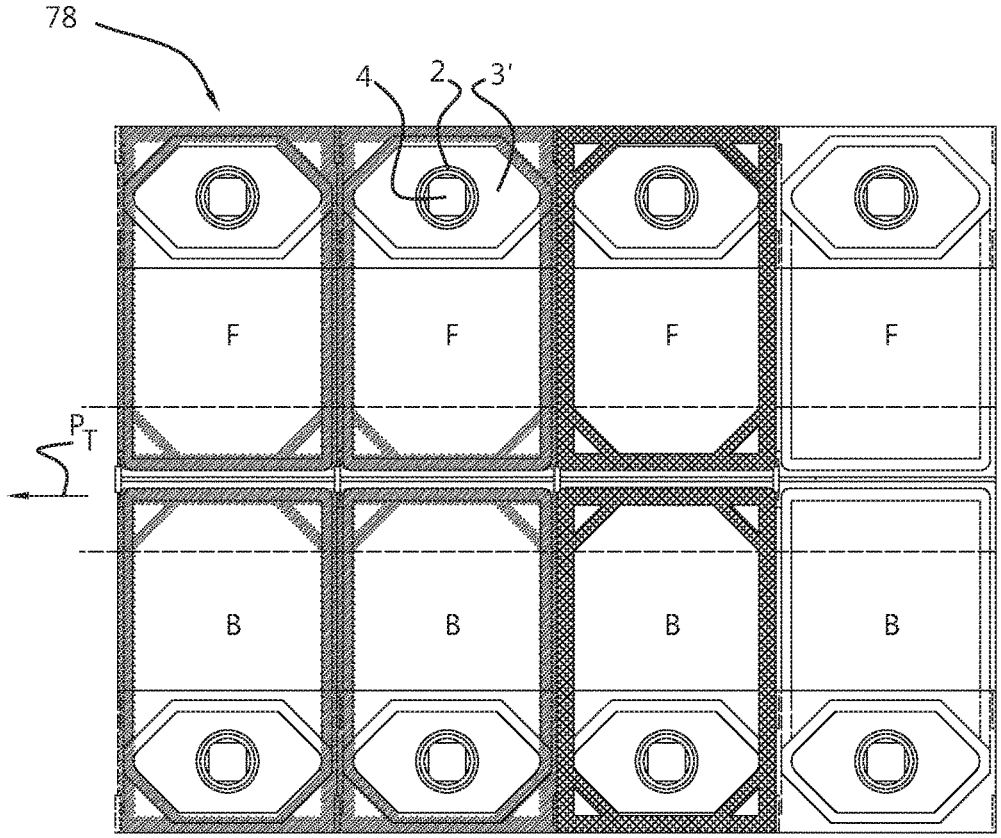

Referring to FIG. 22, in one or more next steps, a (second) seal press unit 190 comprising one or more seal presses is arranged above and below the assembly of strips 63, 65, 67 forming the front and back walls 3, bottom wall 3" and top cover 3' and (partially) seals strips together in the pattern 78 shown in FIG. 22. This sealing process comprises of pressing the strips on each other and welding them together. The process can be repeated a number of times. In the sealing process the side walls 3 of both the first and second strips 63, 65 are welded to one (outer) edge of the top covers 3' only.

The sealing can be performed using an ultrasonic sealing process or a heat sealing process. In embodiments of the present disclosure the heat sealing process is used to seal the edges of pouch material because heat sealing results in a relatively wide seal compared to the seal resulting from ultrasonic sealing. Generally, in ultrasonic heating (resulting in a so-called linear seal) the width of the seal tends to be smaller than the width obtained in heating sealing. Furthermore, the sealing quality of ultrasonic sealing may be affected by the uneven film thickness or flexural film deformation of the walls of the pouch container.

In embodiments of the present disclosure the sealing of spout fitment to the top wall 3' is performed by ultrasonic sealing, while the sealing of walls to other walls is performed by heat sealing. Furthermore, a cooling element may be arranged in the seal press unit 190 above and below the assembly of sealed strips 63, 65, 67. The cooling element may be configured to cool the seals, for instance along the same pattern 78 that is used by the seal press to seal the strips to each other.

Figure 23:
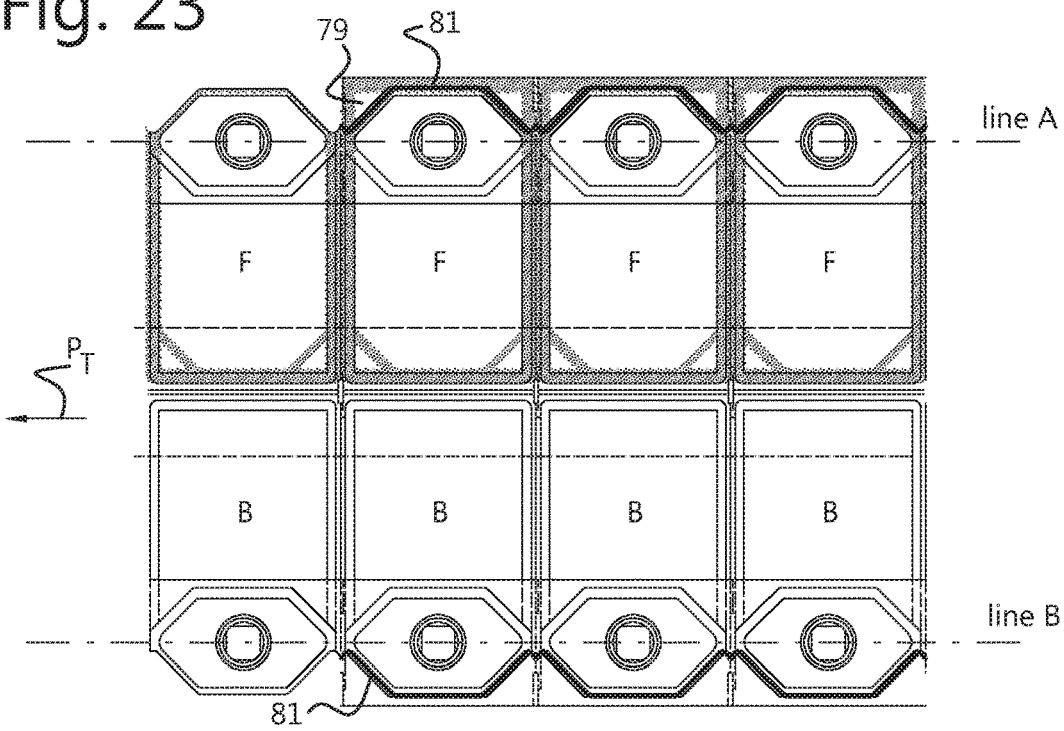

Referring to FIG. 23, in a further step performed by a first cutting unit 200, the strips are cut at their outer edges 79 to bring each of the outer edges of the strips and therefore of the respective parts of the top covers 3' into their final shape. The cutting may be performed by transporting the strips in transport direction $P_T$ along a number of cutting elements 81 of the cutting unit 200 configured to cut the outermost edges of the top covers 3' as they are passing by. FIG. 23 shows that only the two left-most top covers 3' of the leading two pouch containers have been cut to their final shapes. However, as the strips are moved further in transport direction $P_T$ further pouch containers will be cut of course.

Figure 24A:
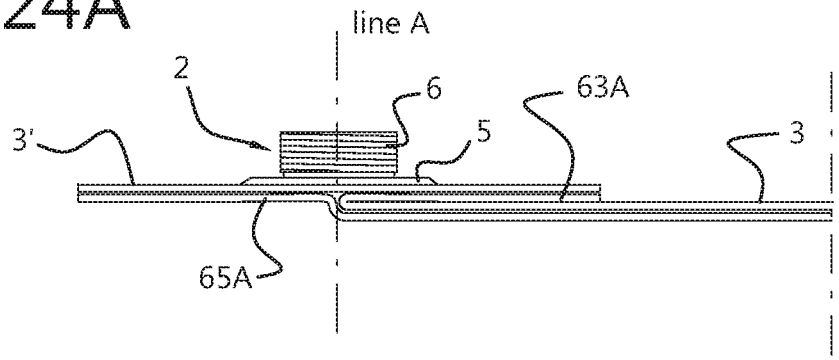
Figure 24B:
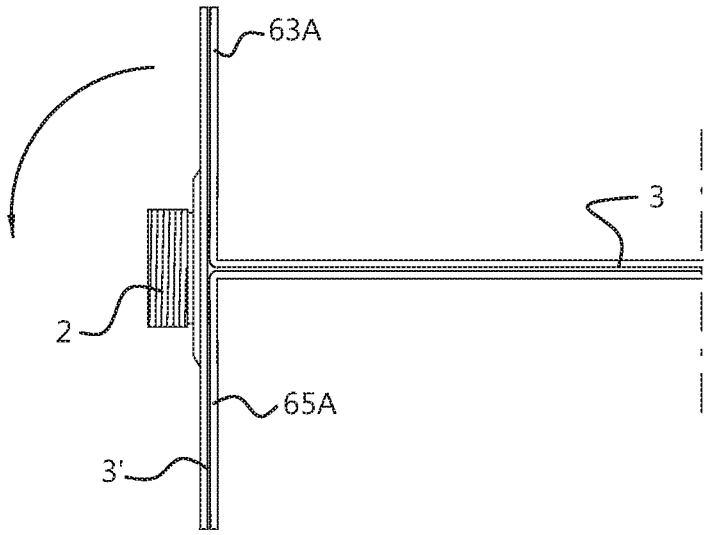

FIGS. 24A-24B elucidate schematically a next step of the manufacturing method performed by a first turning unit 210. FIG. 24A shows the situation after the cutting step showed in FIG. 23. In this situation the cut top covers 3' are positioned in such a manner, that the spout fitments 2 are oriented in an upward manner, i.e. with radial attachment flanges 5 extending in a lying position below the axial tubular spout parts 6 extending in upward direction.

Figure 24C:
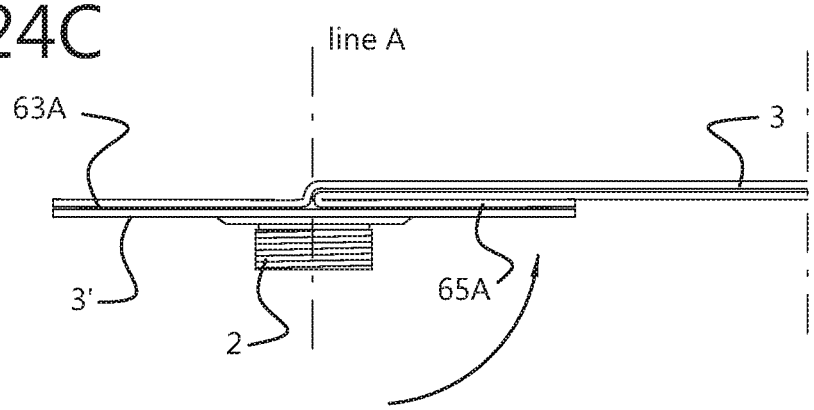

The first turning unit 210 is configured to turn (i.e. to rotate along respective lines A or B) the cut top covers 3' over about 180 degrees so that the spout fitments 2 originally directed upwards come to be oriented in a downward direction. FIG. 24C shows the final, turned position of the cut top covers 3' in this step, while FIG. 24B shows an intermediate position.

Figure 25:
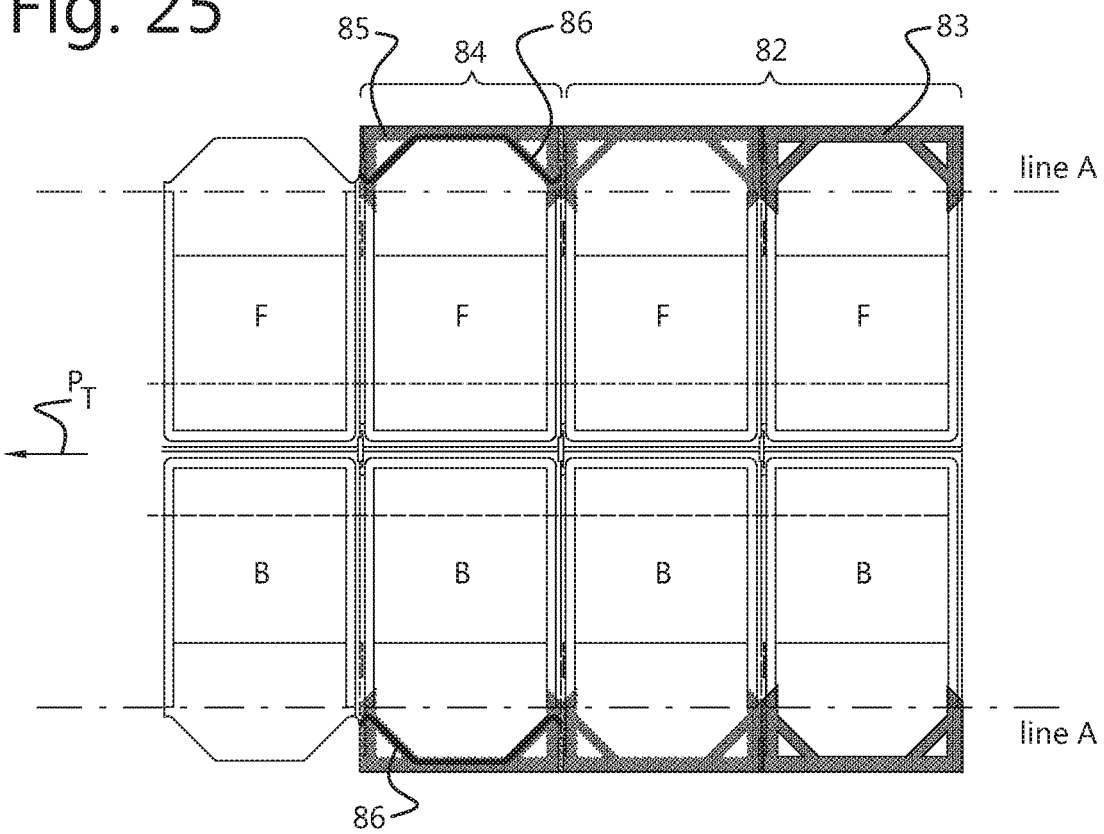

FIG. 25 is a top view similar to the top view of FIG. 23, but wherein the top covers 3' have been turned into the turned position shown in FIG. 24C. The figure shows—amongst others—a view on the outer side 65B of the upper edge of the side wall 3 from the second (lower) strip 65. The figure also shows a further sealing operation. In a further step, a third seal press unit 220 seals the remaining (opposite) edge of the top covers 3' to the edge of the side wall 3 associated with the other strip, i.e. the second (lower) strip 65. The sealing is performed in an area 82 along a pattern 83 (indicated as a shaded area). The sealing step comprises an optional cooling operation in area 84, along a pattern 85 (also indicated as a shaded area).

Referring to the left hand side of the same FIG. 25, it is shown how, in a further step, the cutting elements 86 of a second cutting unit 230 may start cutting the strips at their remaining outer edges of the top covers 3' to bring the top covers 3' in their final shape. In FIG. 25 the leading two pouch containers (shown at the leftmost position in the figure) have obtained their final shape.

Figure 26:
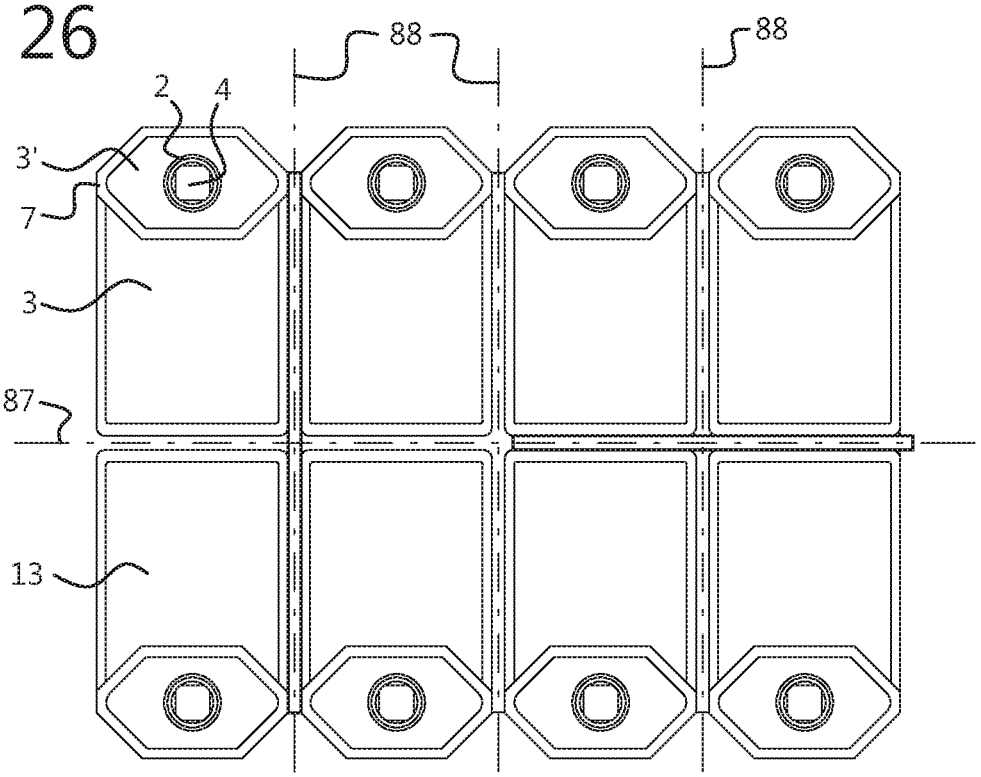
Figure 27:
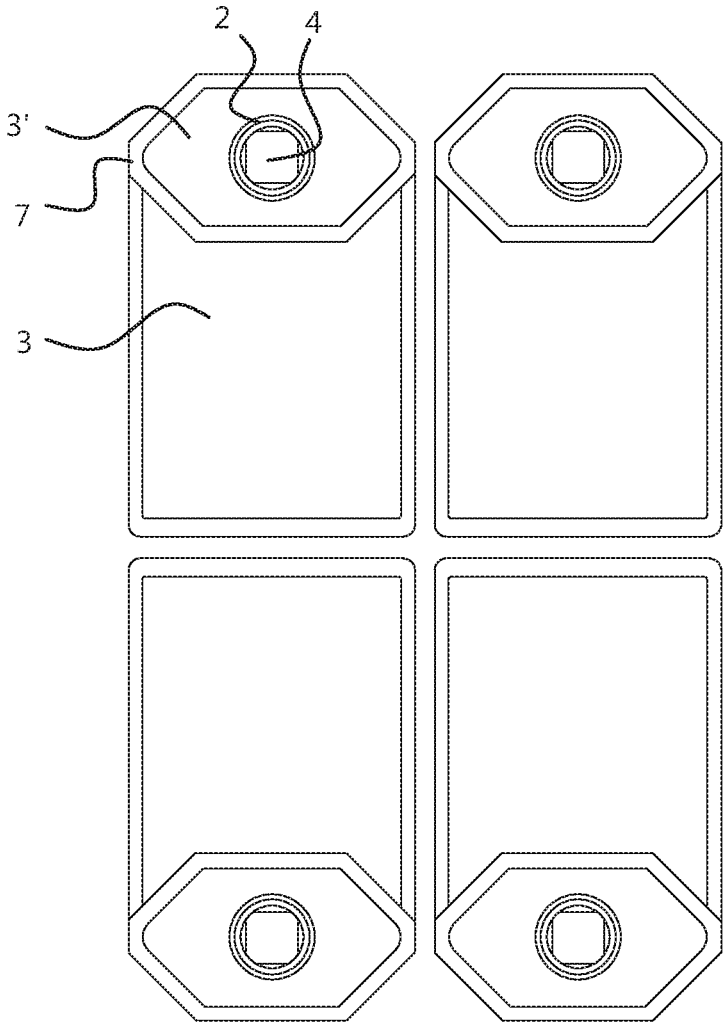

In a further step the top covers 3' and the spout fitments 2 attached thereto can be turned back to their original upright position in a second turning unit 240, to arrive at the position as is shown in FIG. 26. In the final steps a third cutting unit 250 cuts the strips 63, 65, 67 along an imaginary longitudinal line 87 and along transversal lines 88 to provide the individual pouch containers of FIG. 27. The pouch containers of FIG. 27 are similar to the pouch containers in their flat position shown in FIG. 13A.

Typical dimensions of the spouted pouch container to be manufactured by the present manufacturing method are follows: length 10-20 cm, width 10-20 cm, depth 2-4 cm. It is to be understood that pouch containers with other dimensions can be manufactured by the presented manufacturing method as well.

As will be apparent to those of skill in the art upon reading this disclosure, each of the individual embodiments described and illustrated herein has discrete components and features which may be readily separated from or combined with the features of any of the other several embodiments without departing from the scope of the present invention. Any recited method can be carried out in the order of events recited or in any other order which is logically possible.

The invention claimed is:

1. A method for manufacturing a plurality of individual spouted pouch containers, wherein each spouted pouch container comprises walls made of sheet material and a spout fitment sealed to one of the walls, the walls being sealed along their peripheral edges to form a pouch cavity, the method comprising the steps of:

arranging an elongated upper strip and an elongated lower strip of wall sheet material with their inner sides on top of each other, the upper and lower strips configured to form side walls of the pouch containers;

folding at least one longitudinal edge of the upper strip away from the lower strip to expose both an inner side portion of the folded at least one longitudinal edge of the upper strip and an inner side portion of the lower strip;

arranging at least one spouted elongated cover strip on top of the exposed inner side portion of the upper strip and the exposed inner side portion of the lower strip, wherein spout fitments of the at least one spouted elongated cover strip are sealed to an upper side of the at least one spouted elongated cover strip and extend in an upward direction relative to the at least one spouted elongated cover strip, the at least one spouted elongated cover strip configured to form spouted top walls of the plurality of pouch containers; and sealing edges of the side walls of the lower and upper strips to each other and to the at least one spouted elongated cover strip to form the pouch cavity.

2. The method of claim 1, further comprising:

providing at least one elongated cover strip;

placing spout fitments on top of the at least one elongated cover strip; and sealing the placed spout fitments on the at least one elongated cover strip to form the at least one spouted elongated cover strip.

3. The method of claim 2, wherein the spout fitments are sealed by ultrasonic sealing to the at least one elongated cover strip.

4. The method of claim 2, wherein placing the spout fitments on top of the at least one elongated cover strip comprises aligning the spout fitments with respective holes made in or to be made in the at least one elongated cover strip.

5. The method of claim 1, further comprising:

sealing pairs of side walls of the upper and lower strips to each other and sealing the at least one spouted elongated cover strip to the exposed inner side portion of the lower strip;

turning the at least one spouted elongated cover strip to orientate the spout fitments in a downward direction;

sealing the at least one spouted elongated cover strip to the exposed inner side portion of the upper strip;

turning the at least one spouted elongated cover strip back to again orientate the spout fitments in the upward direction; and cutting the upper strip and lower strip into individual pouch containers.

6. The method of claim 1, wherein after sealing the at least one spouted elongated cover strip to the exposed inner side portion of the lower strip, the method comprises cutting into shape the exposed inner side portion of the lower strip and the at least one spouted elongated cover strip connected thereto; and wherein after sealing the at least one spouted elongated cover strip to the exposed inner side portion of the upper strip, the method comprises cutting into shape the exposed inner side portion of the upper strip and the at least one spouted elongated cover strip connected thereto.

7. The method of claim 1, comprising arranging an elongated bottom strip between the upper strip and the lower strip and sealing both the upper strip and the lower strip to the bottom strip, the bottom strip configured to form bottom walls of the pouch containers.

8. The method of claim 1, comprising:

unwinding a single web including the upper strip and the lower strip;

cutting the single web so as to separate the upper strip and the lower strip from each other; and arranging the inner sides of the separated upper and lower strips on each other.

9. The method of claim 1, comprising:

unwinding a single web including the upper strip, the lower strip, and an elongated bottom strip, the bottom strip configured to form bottom walls of the pouch container;

cutting the single web so as to separate the upper strip, the lower strip, and the bottom strip from each other;

arranging the inner sides of the separated upper and lower strips on each other; and arranging the bottom strip between the upper strip and lower strip.

10. The method of claim 1, wherein the side walls of the pouch container are rectangular sheets connected to form a tubular pouch container portion, the method further comprising connecting a first rectangular sheet of a first side wall to a second rectangular sheet of a second side wall by sealing longitudinal edge parts of the first and second sheets to each other to form a tubular pouch container portion, connecting a third sheet of a top wall by sealing associated transversal edge parts of the first and second sheets to the third sheet, and connecting a fourth sheet of a bottom wall by sealing associated transversal edge parts of the first and second sheets to the fourth sheet.

11. The method of claim 1, wherein the spout fitment comprises an attachment flange extending in a first direction and a tubular spout part extending in a second direction, the second direction being perpendicular to the first direction.

12. The method of claim 1, wherein the spout fitment comprises an attachment flange, the attachment flange comprising a center area and a peripheral area around the center area, the method comprising sealing the peripheral area of the attachment flange to the at least one spouted elongated cover strip.

* * * * *